US012044030B2

(12) United States Patent
Ellis et al.

(10) Patent No.: US 12,044,030 B2
(45) Date of Patent: Jul. 23, 2024

(54) SUITABLE, CONVENIENT ACCOMMODATIONS FOR TRAVELING ATHLETIC GROUPS SYSTEMS AND METHODS

(71) Applicant: Frolic & Revelry, LLC, Evergreen, CO (US)

(72) Inventors: Richard Shawn Ellis, Evergreen, CO (US); Alexandra Ellis, Evergreen, CO (US)

(73) Assignee: Frolic & Revelry, LLC, Evergreen, CO (US)

( * ) Notice: Subject to any disclaimer, the term of this patent is extended or adjusted under 35 U.S.C. 154(b) by 0 days.

(21) Appl. No.: 17/048,961

(22) PCT Filed: Apr. 19, 2019

(86) PCT No.: PCT/US2019/028386
§ 371 (c)(1),
(2) Date: Oct. 19, 2020

(87) PCT Pub. No.: WO2019/204774
PCT Pub. Date: Oct. 24, 2019

(65) Prior Publication Data

US 2021/0238874 A1 Aug. 5, 2021

Related U.S. Application Data

(60) Provisional application No. 62/660,055, filed on Apr. 19, 2018.

(51) Int. Cl.
*E04H 1/00* (2006.01)
*E04H 3/02* (2006.01)
(Continued)

(52) U.S. Cl.
CPC ..... *E04H 3/02* (2013.01); *E04H 3/08* (2013.01); *E04H 3/14* (2013.01)

(58) Field of Classification Search
CPC .... E04H 1/02; E04H 3/02; E04H 3/08; E04H 3/14; E04H 1/00
See application file for complete search history.

(56) References Cited

U.S. PATENT DOCUMENTS 1,096,758 A * 5/1914 Rogers ..... E04H 13/005 D25/4
2,154,897 A * 4/1939 Grant ..... E04B 1/34815 D25/4

(Continued)

FOREIGN PATENT DOCUMENTS

WO 2019204774 A1 10/2019

OTHER PUBLICATIONS

U.S. Appl. No. 62/660,055, First Named Inventor Richard Shawn Ellis, filed Apr. 19, 2018.

(Continued)

*Primary Examiner* — Basil S Katcheves
(74) *Attorney, Agent, or Firm* — Santangelo Law Offices, P.C.

(57) ABSTRACT

Embodiments of the present invention may provide a hotel having a hotel team suite (101), a communal zone (146), a secured hotel wing (102) which may have a single door entry (106), a plurality of rooms (106), a team room (112) or the like which provide for specially designed floors and even parts of a hotel floor that can accommodate an entire team in one area. A hotel may provide an exterior with a plurality of patterned rectangular motif structures (150) on a large-scale rectangular projection (147).

18 Claims, 36 Drawing Sheets

(51) Int. Cl.
*E04H 3/08* (2006.01)
*E04H 3/14* (2006.01)

(56) References Cited

U.S. PATENT DOCUMENTS

| | | | | | |
|---|---|---|---|---|---|
| 2,156,859 | A * | 5/1939 | Lowe | E04H 3/08 | 52/106 |
| D184,145 | S | 12/1958 | Peter | | |
| 3,033,499 | A | 5/1962 | Ash | | |
| D197,555 | S | 2/1964 | Garrett | | |
| D205,445 | S | 8/1966 | Williams | | |
| 3,302,340 | A | 2/1967 | Chertkof | | |
| 3,346,997 | A | 10/1967 | Parrish | | |
| D212,844 | S | 12/1968 | Mullen | | |
| D216,424 | S * | 1/1970 | Estes et al. | D25/5 | |
| D222,343 | S | 10/1971 | Mullen | | |
| 3,900,994 | A * | 8/1975 | Van der Lely | E04H 1/04 | 52/72 |
| D241,648 | S | 9/1976 | Magill | | |
| D246,802 | S * | 12/1977 | Mondragon | D25/19 | |
| D252,216 | S | 6/1979 | Whitney | | |
| 4,429,501 | A * | 2/1984 | de Brabant | E04H 1/04 | D25/31 |
| D273,228 | S * | 3/1984 | Cotton | D25/4 | |
| 4,462,191 | A | 7/1984 | Poirier | | |
| 4,599,829 | A * | 7/1986 | DiMartino, Sr. | E04B 1/3483 | 52/106 |
| 4,650,179 | A | 3/1987 | Bond | | |
| 5,775,033 | A * | 7/1998 | Meehan | E04H 3/04 | 52/33 |
| 5,806,260 | A * | 9/1998 | Quaintance | E04H 3/02 | 52/234 |
| 6,044,596 | A * | 4/2000 | Driggett | E04H 5/02 | 588/250 |
| 6,070,320 | A * | 6/2000 | Tomforde | B23P 21/004 | 198/860.3 |
| 6,141,924 | A | 11/2000 | Quaintance | | |
| 6,155,012 | A | 12/2000 | Halbitte | | |
| D648,036 | S | 11/2011 | Herzog | | |
| 8,544,217 | B2 | 10/2013 | Andreini et al. | | |
| 8,584,349 | B2 * | 11/2013 | Scannon | E04H 5/02 | 52/234 |
| D712,067 | S | 8/2014 | Backus et al. | | |
| 9,016,000 | B2 | 4/2015 | Elliott et al. | | |
| D736,947 | S | 8/2015 | Webb | | |
| D750,274 | S | 2/2016 | O'Callaghan et al. | | |
| D750,275 | S | 2/2016 | O'Callaghan et al. | | |
| 9,771,731 | B2 | 9/2017 | Canavati | | |
| D886,323 | S | 6/2020 | Yusupov | | |
| D887,579 | S * | 6/2020 | Ellis | D25/5 | |
| 11,193,288 | B1 * | 12/2021 | Istel | E04H 3/06 | |
| 2003/0019798 | A1 | 1/2003 | Capps et al. | | |
| 2007/0000185 | A1 * | 1/2007 | DeLine | E04H 3/14 | 52/33 |
| 2007/0074471 | A1 * | 4/2007 | Gallagher | E04H 3/02 | 52/236.3 |
| 2009/0107063 | A1 * | 4/2009 | Pierson | E04H 3/02 | 52/234 |
| 2009/0165407 | A1 * | 7/2009 | Toyoshima | E04H 3/02 | 52/236.2 |
| 2010/0058691 | A1 * | 3/2010 | Mannion | E04F 13/0864 | 52/287.1 |
| 2013/0219816 | A1 * | 8/2013 | Elliott | E04H 3/02 | 52/234 |
| 2014/0096456 | A1 | 4/2014 | Andreini et al. | | |
| 2014/0315183 | A1 | 10/2014 | Garcia Valdecasas Canet | | |
| 2015/0089890 | A1 | 4/2015 | McLoughlin et al. | | |
| 2016/0032593 | A1 * | 2/2016 | Biterman | E04F 13/0862 | 264/319 |
| 2017/0175409 | A1 * | 6/2017 | Canavati | E04H 3/22 | |
| 2017/0241144 | A1 * | 8/2017 | Schlyter Gezelius | B32B 7/03 | |
| 2018/0194442 | A1 | 7/2018 | Loudrup | | |

OTHER PUBLICATIONS

United States Design U.S. Appl. No. 29/644,699, filed Apr. 19, 2018. First Named Inventor: Ellis.

Elizabeth Olson, For Athletes, a Home for Away Games, The New York Times, Nov. 4, 2013, 4 pages.

Rising Star Sports Ranch Resort, a Resort Like no Other, Apr. 17, 2018, 4 pages.

Floor Plan 6th floor Spa & Gym, Spa & Gym in Taleon Imperial Hotel—Interactive floor plan. May 30, 2019. 2 pages.

Leathernecks, Leatherneck Indoor Sports Complex. 7 pages.

Fogel, Stephanie. Bringing Esports to a Las Vegas Casino. Apr. 28, 2016. 13 pages.

International PCT Application No. PCT/US19/028386 filed Apr. 19, 2019. International Search Report dated Aug. 12, 2019. 7 pages.

International PCT Application No. PCT/US19/028386 filed Apr. 19, 2019. Written Opinion of the International Searching Authority dated Aug. 12, 2019. 12 pages.

United States Design U.S. Appl. No. 29/644,699, Notice of Allowance mailed Mar. 2, 2020, 11 pages.

United States Design U.S. Appl. No. 29/738,141, filed Jun. 15, 2020. First Named Inventor: Ellis.

United States Design U.S. Appl. No. 29/738,141, filed Jun. 15, 2020. First Named Inventor: Ellis. Non-final Office Action dated Aug. 9, 2021. 7 pages.

United States Design U.S. Appl. No. 29/738,141, filed Jun. 15, 2020. First Named Inventor: Ellis. Final Office Action dated Feb. 28, 2022. 6 pages.

United States Design U.S. Appl. No. 29/738,141, filed Jun. 15, 2020. First Named Inventor: Ellis. Final Office Action dated Nov. 3, 2022. 8 pages.

United States Design U.S. Appl. No. 29/738,141, filed Jun. 15, 2020. First Named Inventor: Ellis. Final Office Action dated Apr. 26, 2023. 7 pages.

United States Design U.S. Appl. No. 29/738,141, filed Jun. 15, 2020. First Named Inventor: Ellis. Notice of Allowance dated Nov. 22, 2023. 7 pages.

* cited by examiner

SUITABLE, CONVENIENT ACCOMMODATIONS FOR TRAVELING ATHLETIC GROUPS SYSTEMS AND METHODS

CROSS-REFERENCES TO RELATED APPLICATIONS

This application is the United States National Phase of International Application No. PCT/US 19/28386, filed Apr. 19, 2019, which claims the benefit of and priority to U.S. Provisional Application No. 62/660,055 filed Apr. 19, 2018, each of which and any priority case are hereby incorporated by reference herein in their entirety.

TECHNICAL FIELD

Generally, this invention may relate to accommodations and building designs for traveling athletic groups. Specifically, embodiments of the present invention may provide sport specific hotels which may be focused on the health and well-being of athletic groups, team members, coaches, personnel, and athletes.

BACKGROUND OF THE INVENTION

In today's world, the sports and athletic industry is booming. Kids' sports alone is a billion-dollar industry. Kids are joining private club teams which frequently travel around the country. In addition, high school, college, and professional athletes travel around the world to compete and play games. These traveling athletic groups stay at hotels that do not adequately accommodated the needs for the sports teams and athletes.

Embodiments of the present invention may provide a hotel system unlike any hotel concept in the world. Hotels have been around a long time but outside of nicer beds, larger rooms and maybe better food, they have not really evolved much. The world, however, has changed dramatically. Ten years ago, 14-year olds did not get on airplanes to go play in a sports tournament, professional athletes did not make $100 million dollars, eSports was not in anyone's lexicon, and even most of America was not yet talking about kale smoothies or yoga. Embodiments of the present invention address these issues and can provide suitable, convenient accommodations that may be tailored to the travelling sports teams and athletes.

DISCLOSURE OF THE INVENTION

The present invention includes a variety of aspects with may be selected in different combinations based upon the particular application or needs to be addressed. In one basic form, the invention provides a hotel system that provides specially designed areas for teams to meet, work, exercise, sleep, and relax. One of the broad objects of the present invention may be to provide for specially designed floors and even parts of a hotel floor that can accommodate an entire team in one area. It is an object of the present invention to provide a team suite that may lodge a team, its players, and even its coaches. It is another object of the present invention to provide a team room that may provide meeting space and the like. Yet another object of the present invention may include a social area perhaps even near hotel rooms perhaps for teams to gather. Another object of the present invention may include a distinct hotel exterior.

Naturally, further objects of the invention are disclosed throughout other areas of the specification and drawings.

MODE(S) FOR CARRYING OUT THE INVENTION

Figure 1:
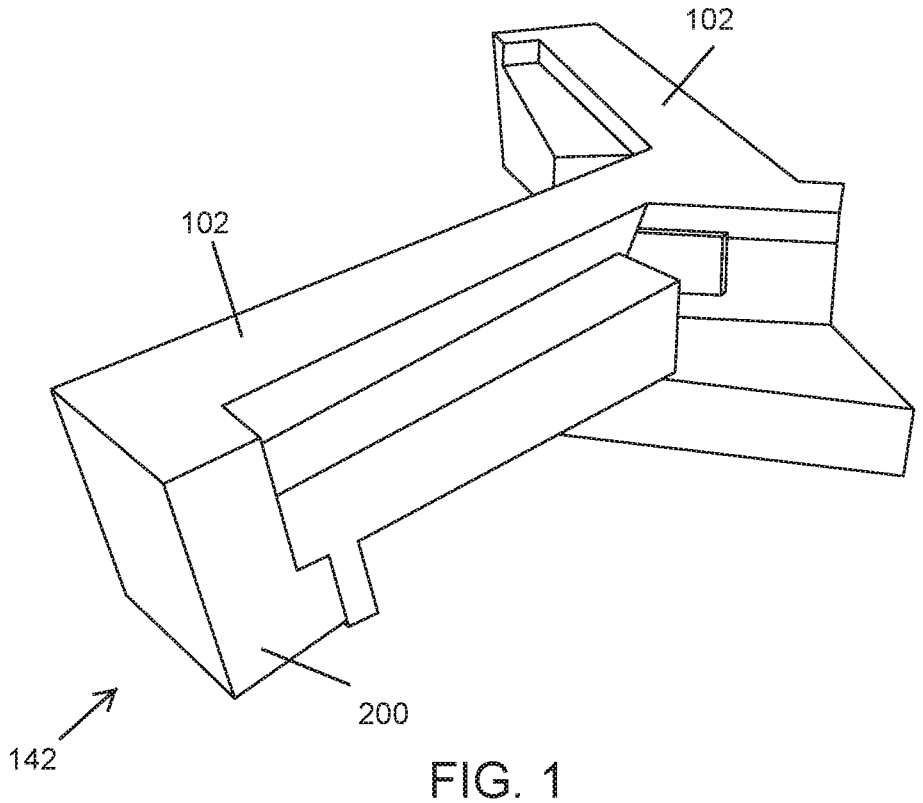
FIG. 1 is a non-limiting example of a 90 room hotel with 5 levels of a hotel system in accordance with some embodiments of the present invention.

As mentioned earlier, the present invention includes a variety of aspects, which may be combined in different ways. The following descriptions are provided to list elements and describe some of the embodiments of the present invention. These elements are listed with initial embodiments; however, it should be understood that they may be combined in any manner and in any number to create additional embodiments. The variously described examples and preferred embodiments should not be construed to limit the present invention to only the explicitly described systems, techniques, and applications. The specific embodiment or embodiments shown are examples only. The specification should be understood and is intended as supporting broad claims as well as each embodiment, and even claims where other embodiments may be excluded. Importantly, disclosure of merely exemplary embodiments is not meant to limit the breadth of other more encompassing claims that may be made where such may be only one of several methods or embodiments which could be employed in a broader claim or the like. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Embodiments of the present invention may provide a hotel designed for athletes which has world class cuisine and live entertainment and the like. A hotel may be located in the epicenter of each city's stadiums, colleges, universities, professional sports complexes, club sport venues, or the like. In embodiments, a hotel may provide a unique room configuration perhaps designed to create a cohesive environment for teams but may also allow a fit traveler to experience a boutique full service hotel experience. A hotel system may focus on the health and well-being of athletes. A hotel system may also attract the daily, weekly, and business traveler perhaps with its unique food and beverage offerings and perhaps even its live entertainment venue. Accordingly, in some embodiments, a hotel system may provide a live entertainment venue or club perhaps seating about 700 people.

A hotel system may provide at least one or more food and beverage offerings. A 360 athlete may follow a non-traditional eating schedule. In the past, hotels may not have always had food readily available at any time of the day. For an athlete, food may be synonymous with fuel to compete. Perhaps the higher the fuel quality, the greater the chances of success. To address this problem, a hotel system may include vending units, perhaps even wall mounted vending units, that perhaps with a swipe of a room key, may allow access to a metered meal of elite fuel in the form of refined cuisine that carries with it a list of calories, ingredients, and all nutritional facts that may maintain natural circadian rhythms and optimal peak performance cycles.

In the past, a traveling athlete may need to adjust their daily regiment in today's market. Therefore, in some embodiments, a hotel system may be designed to help the athlete to maintain their regime, and perhaps elevate their daily routine. To assist in surpassing the typical mundane experience for an athlete, a hotel system may be designed to attract club, college, professional, and the like types of teams. A hotel system may look at all areas of an athlete's day and may frame the hotel in such a way that helps them to complete their daily work and at the same time offer a place to entertain their friends, teammates and fans inside the hotel. A hotel system may provide the ability for athletes to workout, may allow team preparation, and perhaps even may provide recovery options. For example, a hotel system may be designed as a destination to train, for some. Some guests may have a regiment in place, and, instead of building their form, they may be competing and thereby looking to recover and regenerate. A hotel system may provide a regeneration and recovery portion of the facility that may boast state of the art luxury amenities. That area may feature open space for stretching, rolling, private massage facilities, or the like. This may include plunge pools and even aquatic therapy tanks and the like. Private rooms can be utilized by teams and individuals for needling, cupping, and even acupuncture perhaps available at a moment's notice.

A hotel design may have an upper lobby level which may feature a full fitness facility perhaps with a closed area that can be exclusive for traveling professional athletes. Rooms in a hotel system may be mindfully designed for the 360 athlete perhaps with full ice baths, massage/physio areas, and the like. In embodiments, full team floors may be provided for larger teams perhaps even with a coach's suite that can help the coach to develop a team comradery on the road. Embodiments of the present invention may provide accommodations for the non-athlete. Rooms may be designed to not only be athlete friendly but appointed in a boutique/luxury style that can attract the traveler that would otherwise seek out a luxury stay.

In some embodiments, the top floors (perhaps even the top four floors as an example only) can be designed specifically for the higher profile athletes and celebrities. A private check in may be provided to meet the need for privacy of these athletes and celebrities alike, and these areas are designed with a mindset where ultra-luxury, privacy, and elite training needs meet.

Each floor of a hotel system may be designed in a manner that allows teams to be cohesive during their stay. Embodiments of the present invention may provide that each team may stay together perhaps in a separate part of the hotel. Floors may be designed to accommodate one team, two teams, three teams, four teams or more or the like. For example, in one embodiment, a floor may accommodate two full teams of 30 players perhaps along with three coaches and maybe even a physio/trainer per team.

A hotel system may provide a destination to train, regiment to maintain, or a place to recover and regenerate. Facilities may include fitness, recovery, entertainment, and perhaps even refueling. A hotel system may feature open spaces for stretching, rolling and private massage facilities, plunge pools, aquatic therapy tanks, and perhaps even rooms for private treatments. The present invention may provide in embodiments, a hotel system which may include at least one or all or any combination of the following facilities to: compete, recover, refuel, focus, rest, connect, or the like. Facilities accommodating the compete aspect may include challenge, dedication, endurance training, work-out and the like. Facilities accommodating the recover aspect may include individual treatment, group treatment, physio, relax, massage, yoga, stretching, preserve, concussion evaluation, restore, cryo-therapy, sensory deprivation, hyperbaric chamber, compression, dry needling, cupping, treating ailments, precaution treatments, physical therapy, meditation, centering, zen, mind training, and the like. Facilities accommodating the refuel aspect may include a variety of food options, on demand food, dietary options, and the like. Facilities accommodating the connect aspect may include games, media, social options, and the like. Facilities accommodating the rest aspect may include comfort, safety, quiet, and the like. Facilities accommodating the focus aspect may include strategy, preparation, study, and the like.

Embodiments of the present invention may provide various floor plans for a hotel system. In embodiments, a team floor plan may include a team lounge, a coach's suite, individual athlete rooms, a physio room, a team meeting room, and perhaps even assistant coach's rooms. A coach's room may include office space, appropriate software technology which may allow the coach to communicate with the team at the touch of a button. A coach's suite may include, but is not limited to, three rooms. A team meeting room may accommodate an entire team perhaps with state of the art technology which may assist the team in reviewing past performances and strategize for future games. A physio room may be used for regeneration and relaxation.

Embodiments of the present invention may provide an athlete room which may have oversized beds, the room may include an ice maker perhaps to create cold water regeneration baths, and perhaps even the room may include a charging station that can allow the athlete's electronics to be charged all at once. An athlete room may include an equipment tree which may have forced air to dry out boots, shoes, cleats, gear, and the like. A room may be designed to be converted into a two-bedroom suite. For example, outer doors of a one-bed room may be opened perhaps to create a two-bedroom suite. This may be nice for family members that are staying with the athlete.

Embodiments of the present invention provide, in some embodiments, a sports-centric hotel that may be designed from the ground-up for all levels of travelling sports teams perhaps as well as active professionals, gamers and anyone looking for a unique hotel experience. A system may consider an entirety of the experience. Food and beverage may not be subservient to the hotel, they may be an integral part of the refueling and nutrition required for peak performance, whether at a Sunday NFL game, two-day soccer tournament, corporate strategy meeting or perhaps even an eSports gaming competition. Some embodiments of the present invention may be predicated upon active lifestyles. That can mean an early morning workout in a state-of-the-art workout facility, throwing axes or even scrambling up a climbing wall at 7 am, or perhaps even jumping on a gaming console to play someone in Asia over gigabyte internet speeds.

Embodiments of the present invention may provide three segments: sports teams, corporate events, and perhaps even esports. Sports may include, but is not limited to, professional, college/amateur, and perhaps youth or the like. Corporate may include but is not limited to team building, social, and even professional aspect.

Whether referring to professional, college, or youth sports, a plethora of amenities may exist that can appeal to all levels in various embodiments of the present invention. Technology may play an increasing role in the development and even evaluation of athletes from an early age. Team section perhaps on some of the floors may have large screen TV's, data ports, plenty of space for downloading biometric data from athletes, viewing game videos, and perhaps even crunching statistics. Recovery may be a key to ensuring optimum performance. A hotel may provide a full-service treatment center such as with physical therapists and orthopedic professionals on site perhaps even with a vast network of doctors of all specialties on call. Compression therapy, ice baths, ankle wrapping—whatever the athlete needs may be easily accomplished on site. A full-service spa may provide deep tissue therapeutic massage as well as other innovative and even luxurious services. Whether the night before or after a competition, relaxation may often be under-valued in a performance equation. Embodiments of the present invention may provide avenues to relaxation. For example, a guest can watch a movie, relax in the privacy of their luxury accommodations, enjoy the company of their fellow athletes in a team room, perhaps whatever may expedite decompression and even preparedness for the next event. Nutrition may provide a basis for preparation, performance and even recovery, and a multitude of dining options may be provided perhaps to provide a platform for sustenance that nourishes in the most exquisite of ways.

For an individual traveler, rooms of a hotel system may provide hi speed wi-fi, multiple charging ports, crystal clear large screen TV's, or the like. Business printing may be easy with one-click printing perhaps to a high capacity unit that may be located on every floor in the team section or, for larger jobs, directly to a full service print shop downstairs.

Embodiments of the present may provide a hotel team suite comprising a secured hotel wing comprising a hallway and a plurality of rooms located on each side of said hallway; a single door entry into said secured hotel wing; wherein said plurality of rooms comprises: a coach room on each side of said hallway and located next to said single door entry; up to about eight player rooms on each side of said hallway sequentially located next to each of said coach room; a second coach room on each side of said hallway located next to said up to about eight player rooms; and an equipment room located on one side of said hallway after one of said second coach room; and perhaps even a team room located at an end of said secured hotel wing next to said equipment room on one side of said hallway and next to said second coach room on an other side of said hallway. It may also provide a method of providing a hotel team suite comprising the steps of providing a secured hotel wing comprising a hallway and a plurality of rooms located on each side of said hallway; entering said secured hotel wing through a single door entry; wherein said plurality of rooms comprises, at least two coaches room, player rooms, and an equipment room; locating a coach room on each side of said hallway next to said single door entry; locating up to about eight player rooms on each side of said hallway sequentially next to each of said coach rooms; locating a second coach room on each side of said hallway next to said up to about eight player rooms; locating an equipment room on one side of said hallway after one of said second coach room; and perhaps even locating a team room at an end of said secured hotel wing next to said equipment room on one side of said hallway and next to said second coach room on an other side of said hallway.

Other embodiments of the present invention may provide a hotel comprising a team room located in a hotel wing on a floor of said hotel, wherein said team room comprises a meeting space, an audio visual area, and perhaps even a physical recovery area or even a method of providing a hotel comprising the steps of providing a team room in a hotel wing on a floor of said hotel, wherein said team room comprises a meeting space, an audio visual area, and perhaps even a physical recovery area.

Yet other embodiments of the present invention may provide a sports hotel team social space comprising at least one floor of a hotel having at least one wing; and perhaps even a communal zone near said at least one wing and located near an elevator of said hotel or a method for providing a sports hotel team social space comprising providing at least one floor of a hotel having at least one wing; and perhaps even locating a communal zone near said at least one wing and near an elevator of said hotel.

In yet other embodiments, the present invention may provide a hotel building exterior comprising a large-scale rectangular projection on at least a front of a building; and perhaps even a plurality of patterned rectangular motif structures within said large-scale rectangular projection creating a pattern on said large-scale rectangular projection or a method for providing a hotel building exterior comprising providing a large-scale rectangular projection on at least a front of a building; placing a plurality of patterned rectangular motif structures within said large-scale rectangular projection; and perhaps even creating a pattern on said large-scale rectangular projection.

Figure 2:
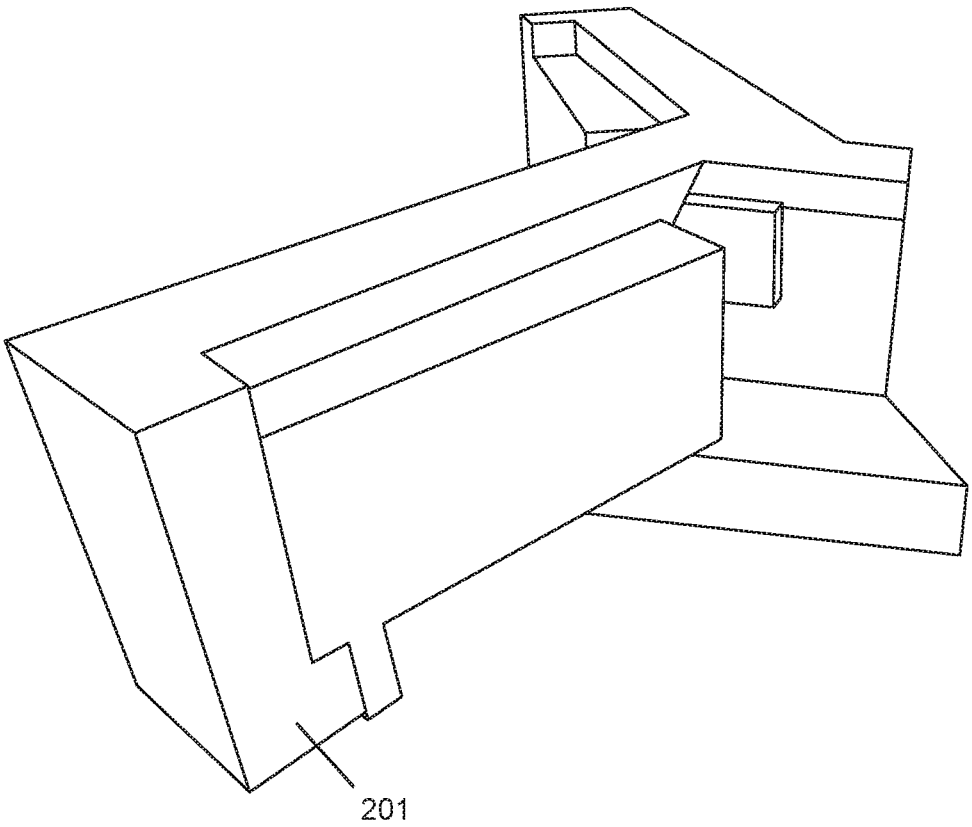
FIG. 2 is a non-limiting example of a 180 room hotel with 8 levels of a hotel system in accordance with some embodiments of the present invention.

FIG. 1 shows a non-limiting example of a hotel (142) that may perhaps provide a room capacity of about 90 rooms and FIG. 2 shows a non-limiting example of a hotel system that may provide a room capacity of about 180 player rooms modules. This is an example only and in any of the examples provided herein, the number of rooms may vary, the placement of each type of room may vary, it may vary as to which rooms are included on a floor or in a team suite, and the like. All examples presented in this application are not meant to be limiting and can be modified. A 90 room module may have about 5 levels (200) and a 180 room module may have about 8 levels (201). Of course, any number of rooms or levels or wings may be used and all are meant to be included in this disclosure. These non-limiting example modules may have two main wings (102) perhaps organized around a central hub. The first two levels may be centered around a program supporting recovery, refueling, and perhaps even connecting. Team suites may be stacked in a same two wing configuration perhaps organized around a central hub which may act as an additional connection space. In some embodiments the top two levels (or any level) may accommodate a lifestyle floor perhaps for a single traveler or the like or may even accommodate a pro floor perhaps for an elite athlete or the like.

Figure 3:
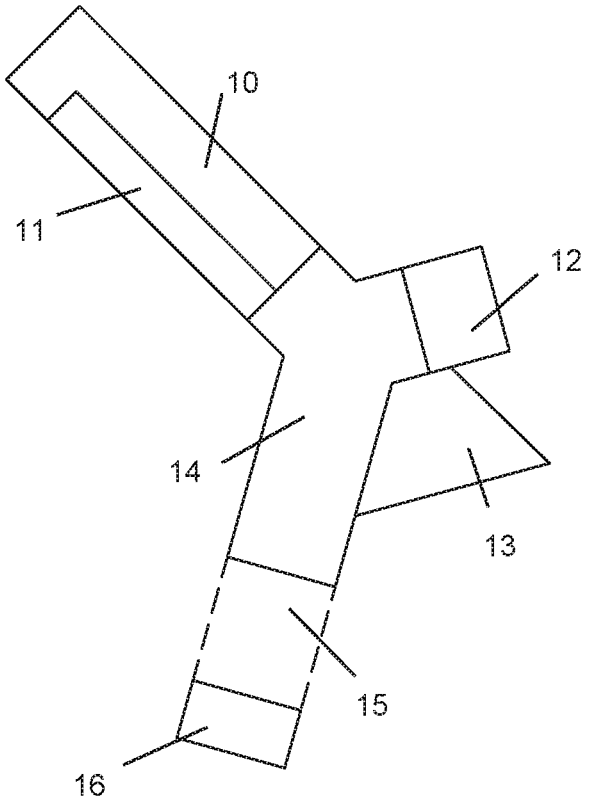
FIG. 3 is a non-limiting example of a ground floor of a hotel system in accordance with some embodiments of the present invention.

FIG. 3 provides a non-limiting example of a ground floor for a hotel. In some embodiments of the present invention, a ground floor may include, but is not limited to: an area to refuel and connect (10), (12); a service area (11), (16); a lobby (13); a social area (14); an area that may be open (perhaps even open to below) (15); any combination thereof; or the like. A ground floor of a hotel may provide recovery and treatment including but not limited to a front desk, an office, a waiting room, group treatment rooms, private treatment rooms, weight room, cardio room, pool, restrooms, locker room, or the like.

Figure 4:
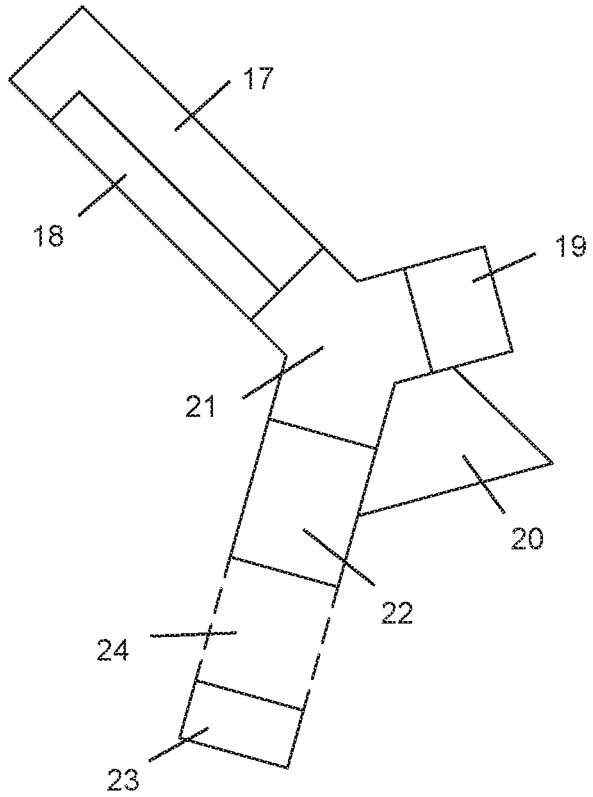
FIG. 4 is a non-limiting example of a second floor of a hotel system in accordance with some embodiments of the present invention.
Figure 5:
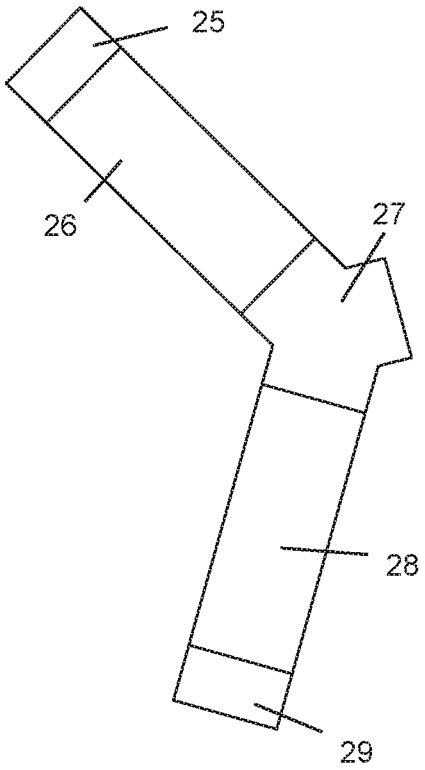
FIG. 5 is a non-limiting example of a guest room floor plan of a hotel system in accordance with some embodiments of the present invention.

FIG. 4 provides a non-limiting example of a recovery floor which may be on a second floor for a hotel. In some embodiments of the present invention, a recovery floor may include, but is not limited to: a recover area (17); a service area (18), (23); an area that may be open (perhaps open to below) (19), (20), (22), (24); a social area (21); any combination thereof; or the like. FIG. 5 provides a non-limiting example of a guest room floor for a hotel. In some embodiments of the present invention, a guest room floor may include, but is not limited to: a team space (25), (29); rooms for players or even coaches (26), (28); a social area (27); any combination thereof; or the like.

Embodiments of the present invention may provide a treatment center (170) in a hotel. A treatment center (170) may provide but is not limited to a stretching space, a rolling space, a private massage facility, an aquatic therapy tank, trainers, athletic trainers, individual treatment, group treatment, compression therapy, physical therapy, orthopedic professionals, doctors on call, ice baths, hot tubs, massages, therapeutic massage, any combination or permutation thereof, or the like. In some embodiments, a treatment center may be located on a second floor (260) of a hotel or any floor of a hotel.

Figure 6:
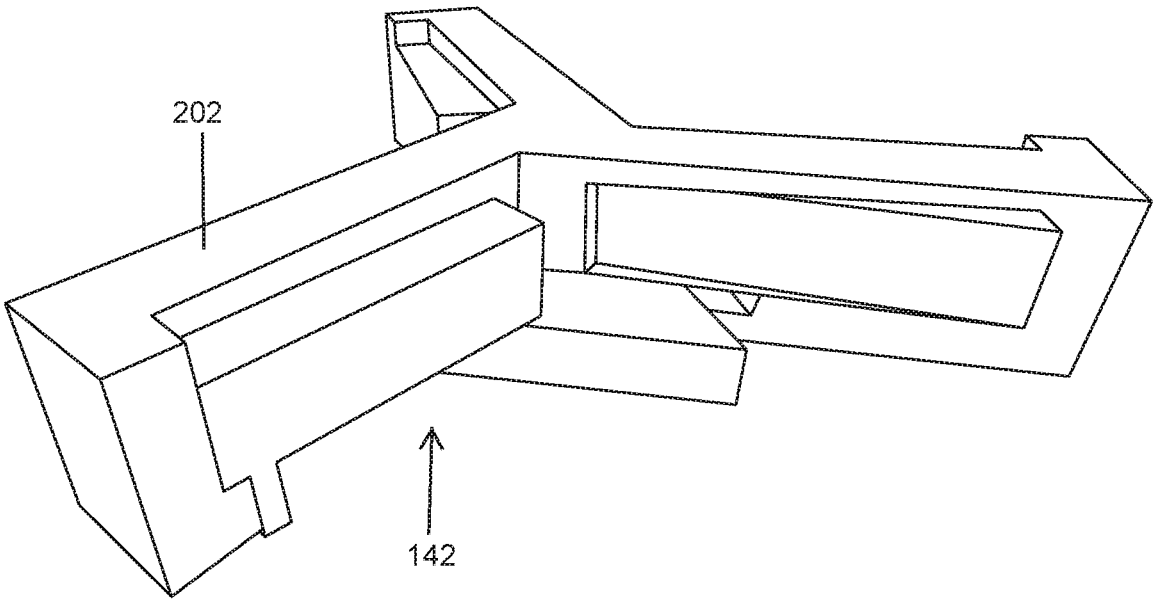
FIG. 6 is a non-limiting example of a 180 room with 5 levels of a hotel system in accordance with some embodiments of the present invention.
Figure 7:
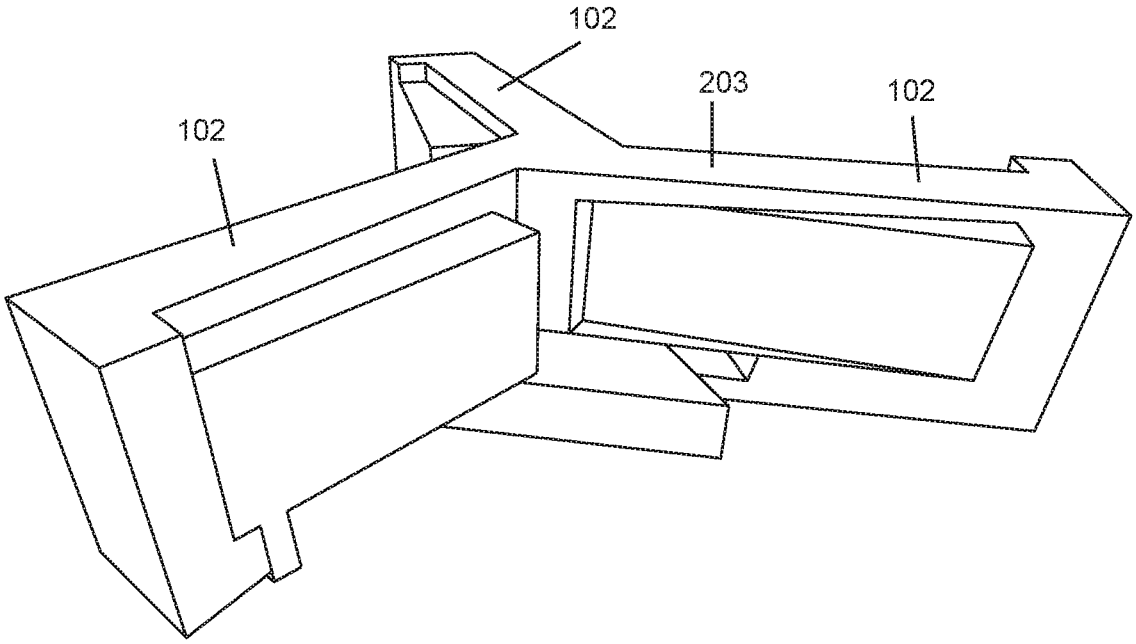
FIG. 7 is a non-limiting example of a 360 room with 10 levels of a hotel system in accordance with some embodiments of the present invention.

FIG. 6 show a non-limiting example of a hotel (142) with perhaps about 180 rooms (202) and FIG. 7 shows a non-limiting example of a hotel system that may provide a room capacity of about 360 rooms (203). A 180 room module may have about 5 levels and a 360 room module may have about 10 levels. Of course, any number of rooms or levels or wings may be used and all are meant to be included in this disclosure. This non-limiting example module may have three main wings (102) perhaps organized around a central hub. The first two levels may be centered around a program supporting recovery, refueling, and perhaps even connecting. The room increase may create additional refuel and even connect spaces on a ground level, perhaps including a multi-purpose meeting space. Team suites may be stacked in a same three wing configuration perhaps organized around a central hub which may act as an additional connection space. In some embodiments the top two levels (or any level) may accommodate a lifestyle floor perhaps for a single traveler or the like or may even accommodate a pro floor perhaps for an elite athlete or the like.

Figure 8:
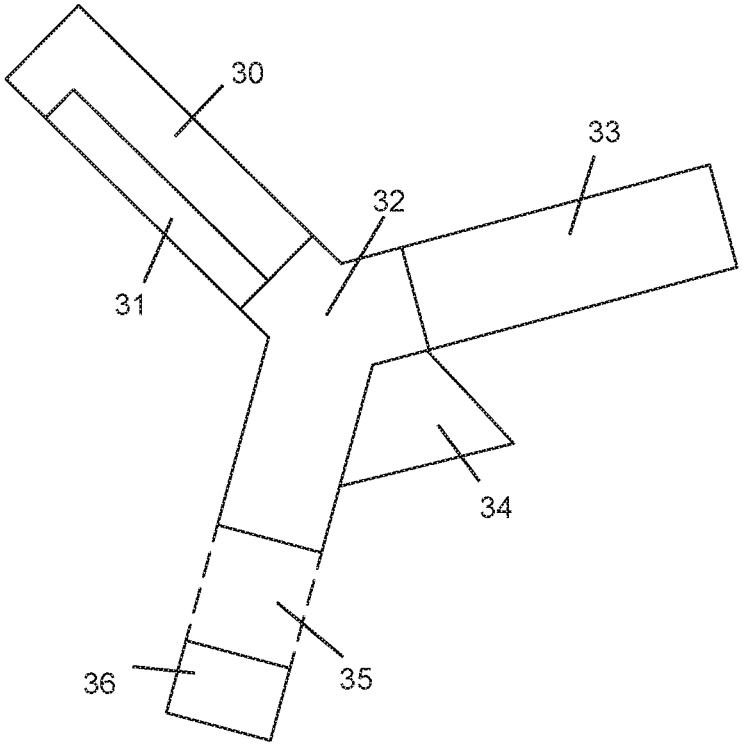
FIG. 8 is a non-limiting example of a ground floor of a hotel system in accordance with some embodiments of the present invention.
Figure 9:
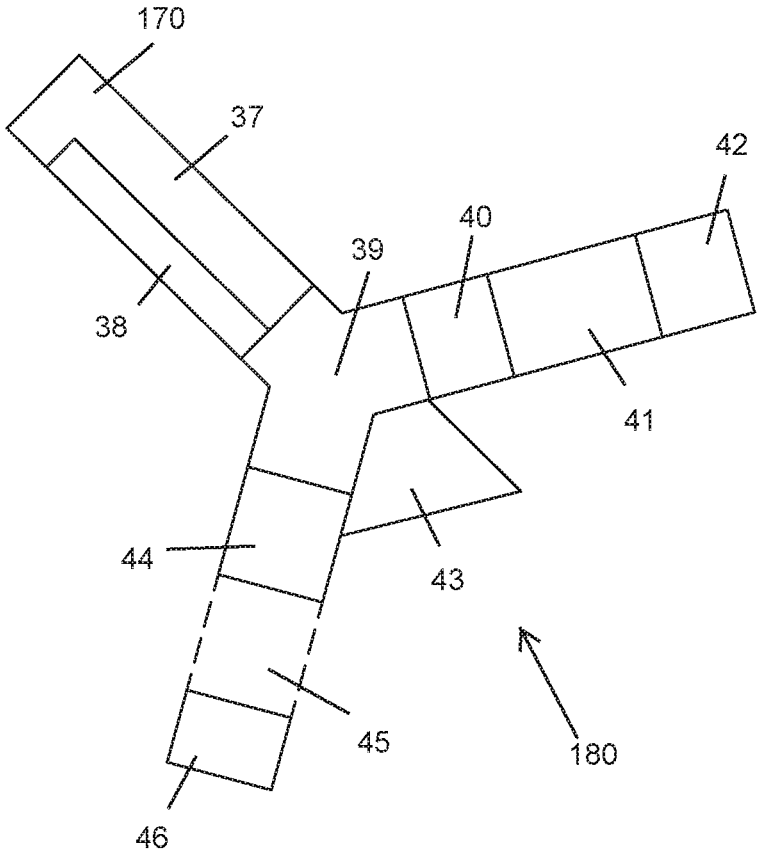
FIG. 9 is a non-limiting example of a second floor of a hotel system in accordance with some embodiments of the present invention.
Figure 10:
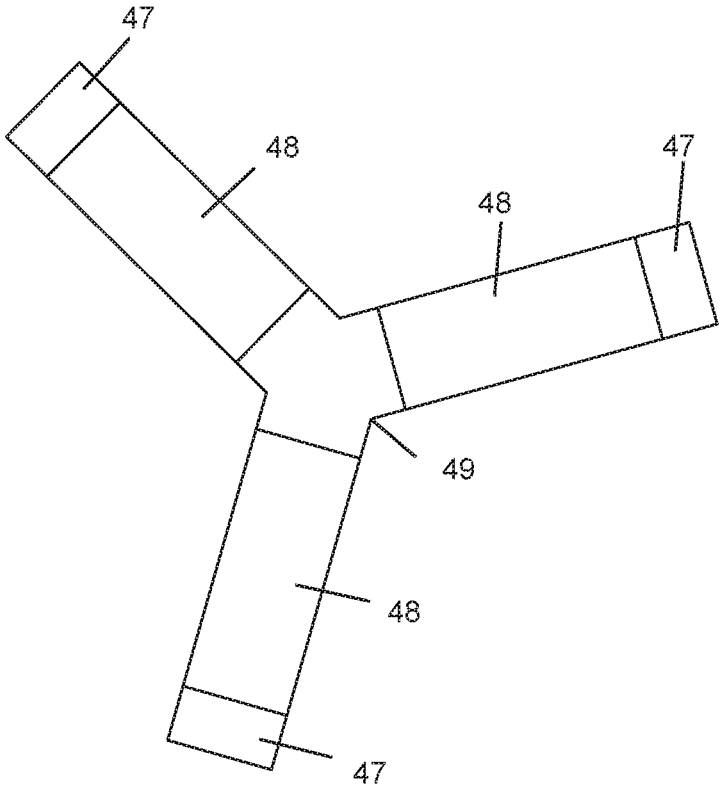
FIG. 10 is a non-limiting example of a guest room floor plan of a hotel system in accordance with some embodiments of the present invention.

FIG. 8 provides a non-limiting example of a ground floor for a hotel. In some embodiments of the present invention, a ground floor may include, but is not limited to: an area to refuel and connect (30), (33); a service area (31), (36); a lobby (34); a social area (32); an area that may be open (perhaps even open to below) (35); any combination thereof; or the like. FIG. 9 provides a non-limiting example of a recovery floor (180) for a hotel. In some embodiments of the present invention, a recovery floor may include, but is not limited to: a recover area or even meeting area (37); a service area (38), (42), (46); an area that may be open (perhaps open to below) (43), (44), (45); a social area (39); a pre-function space (40); a space (41); any combination thereof; or the like. FIG. 10 provides a non-limiting example of a guest room floor for a hotel. In some embodiments of the present invention, a guest room floor may include, but is not limited to: a team space (47); rooms for players or even coaches (48); a social area (49); any combination thereof; or the like.

Figure 11:
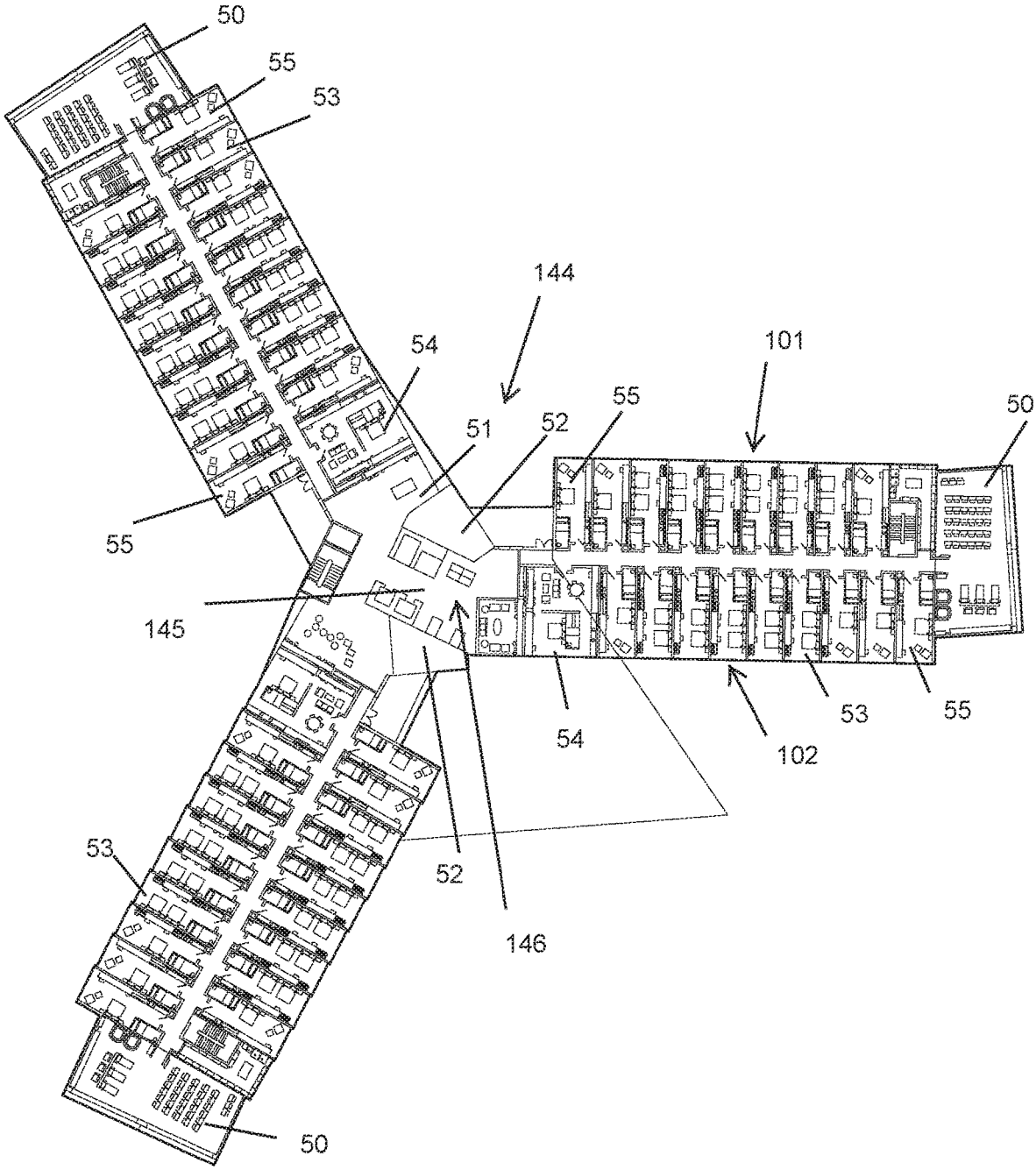
FIG. 11 is a non-limiting example of a team suite floor plan having three wings for a hotel system in accordance with some embodiments of the present invention.
Figure 12:
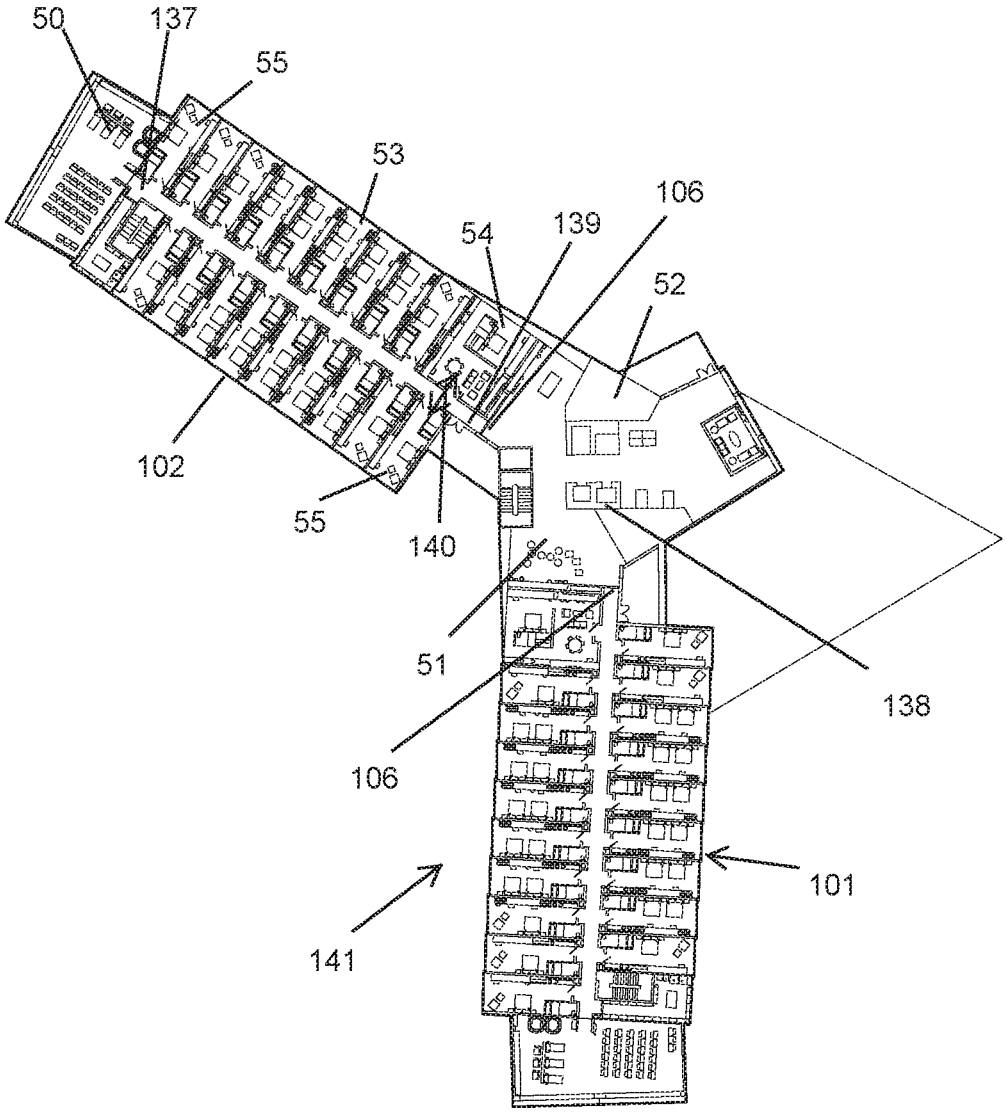
FIG. 12 is a non-limiting example of a team suite floor plan having two wings for a hotel system in accordance with some embodiments of the present invention.
Figure 34:
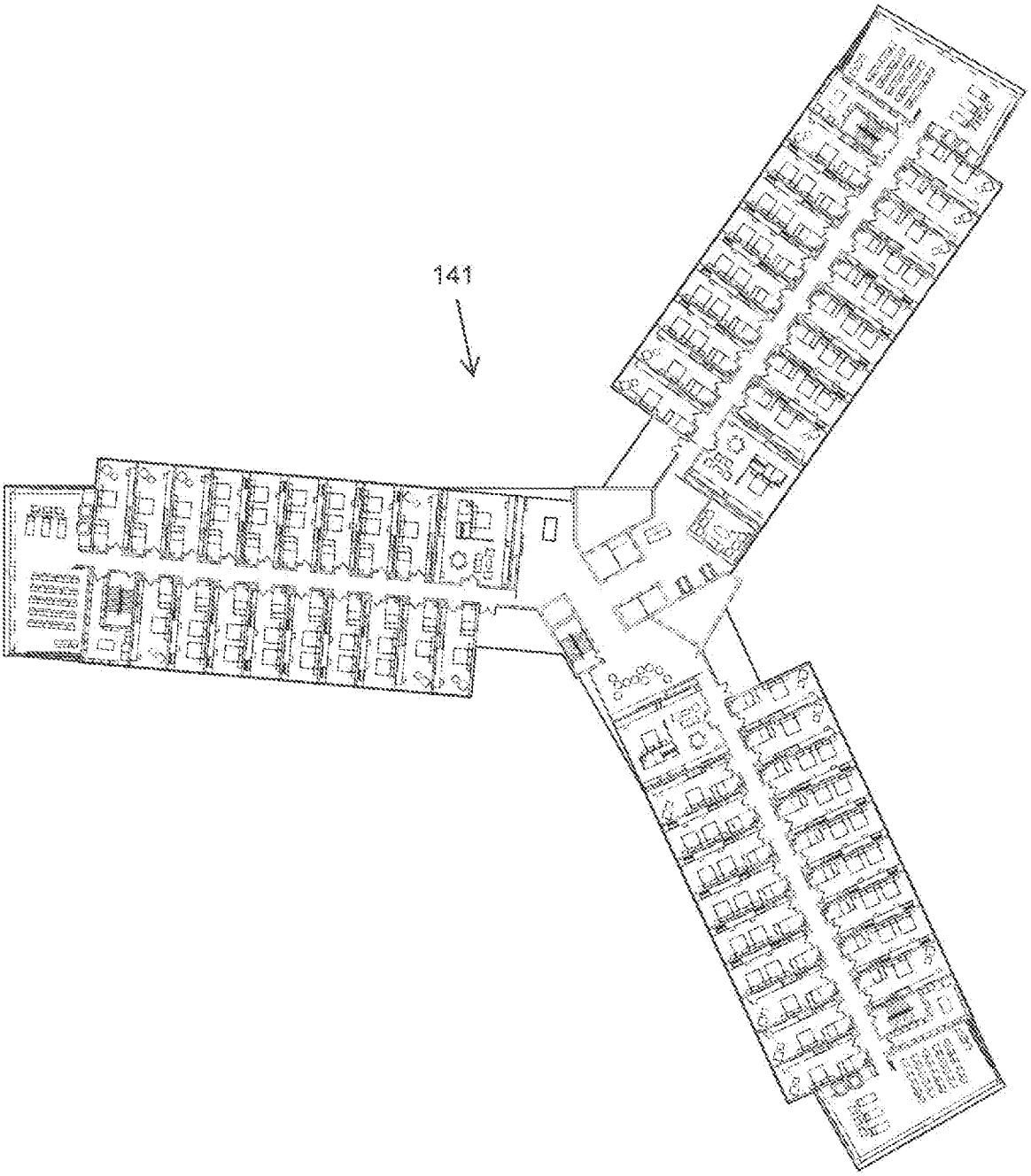
FIG. 34 is a non-limiting example of a floor of a hotel in accordance with some embodiments of the present invention.

FIGS. 11, 12, and 34 show non-limiting examples of a floor perhaps having two or three wings (102) in accordance with some embodiments of the present invention. In some embodiments of the present invention, a floor may include, but is not limited to: a team space (50); a social space (51); a service area (52); player rooms (53); coach rooms (54), (55); any combination thereof; or the like as may be understood in FIGS. 11 and 12.

Figure 15:
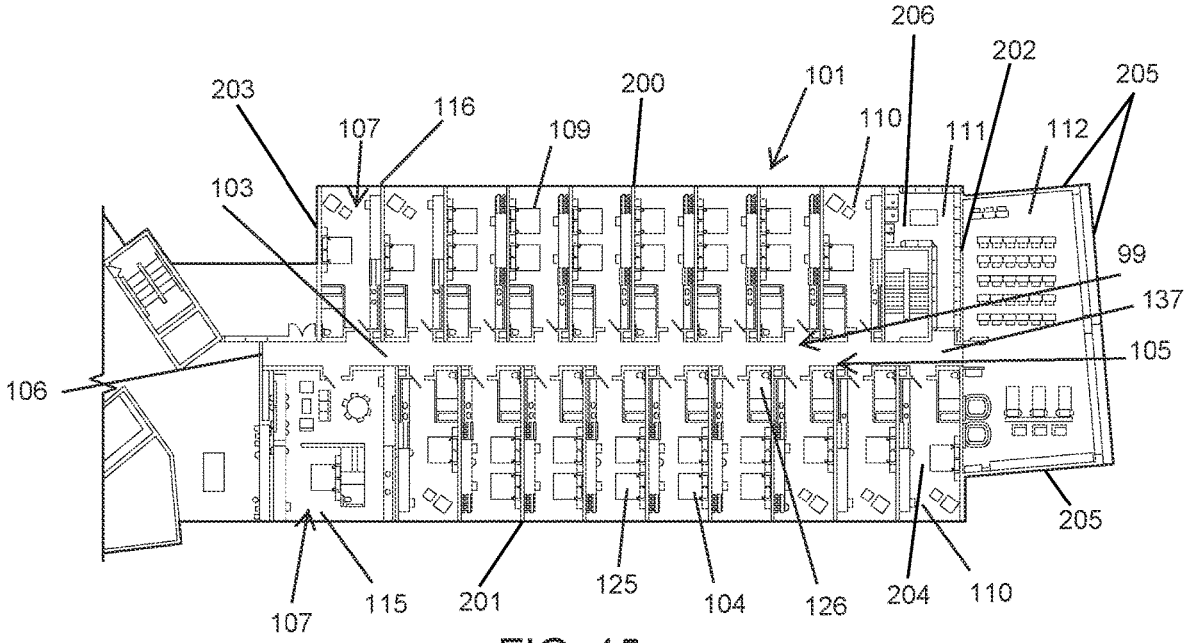
FIG. 15 is a non-limiting example of a team suite for a hotel system in accordance with some embodiments of the present invention.

FIG. 15 provides a non-limiting example of a team suite layout in accordance with some embodiments of the present invention. A hotel may provide at least one hotel team suite (101). A hotel wing (102) may include a hallway (103) and even a plurality of rooms (104) (such as player rooms and even coaches rooms) perhaps located on each side (99), (105) of a hallway. A hotel wing (102) may be a secured hotel wing. A single door entry (106) may be provided to enter a hotel wing. A plurality of rooms (104) may include, but is not limited to, at least one coach room (107), player rooms (109), a second coach room (110), and perhaps even an equipment room (111), or the like. A team room (112) may be provided in a hotel wing. A coach room may be located on each side of a hallway (103) and may even be located next to a single door entry (106). Perhaps two coaches room may be located next to a single door entry which may enhance the security of the team staying in a team suite of a hotel wing. A single door entry (106) may be located at one end (139) of a hotel wing and perhaps even near an elevator (138). Two coach rooms which may each be on one side of a hallway perhaps each next to a single door entry may be located across (140) from each other. A coach room (107) may be designed different from a player room. A coach room may be a head coach room, an assistant coach room, a therapist, or any other person that may help with a team, or the like. In some embodiments perhaps where a coach room may be located on each side of a hallway, one of the rooms may be a head coach room (115) and the other may be an assistant coach room (116). A second coach room (110) may be an assistant coach room (116).

In some embodiments, up to about eight player rooms may be located on each side of said hallway perhaps sequentially located next to each of the coaches rooms as may be understood in FIG. 15. A second coach room (110) may be located on each side of a hallway perhaps next to the up to about eight player rooms. An equipment room (111) may be located on one side of a hallway perhaps after a second coach room. A team room (112) may be located at an end (137) of a hotel wing perhaps next to an equipment room that may be located on one side of a hallway and even next to a second coach room on an other side of a hallway. A team room (112) may be adjacent to, perhaps even parallel to, an equipment room and even a second coach room. A team room may be larger than an equipment room and a second coach room. In some embodiments a team room (112) may be a secured team room which may be accessible perhaps only by guests staying in rooms of a hotel wing or floor near a team room.

Player rooms perhaps located on each side of a hallway may have seven player rooms on one side of a hallway and perhaps even eight player rooms on the other side of a hallway. In some embodiments, an assistant coach room may be located on the side of a hallway next to the seven player rooms and perhaps even a head coach room may be located of the side of a hallway next to the eight player rooms. Of course, any number of rooms, including player rooms and coach rooms, and any placement of the rooms, may be utilized and all are meant to be included in this disclosure.

A hotel (142) may have at least one hotel wing (102), may have two hotel wings, may have three hotel wings, or more. A hotel wing may be at least one floor (141) or may have more than one floor. A hotel wing may be a rectangular shape, perhaps a substantially rectangular shape as may be understood in FIG. 11. Of course, it may not be perfectly rectangular, it may have non-rectangular aspects or may be any other shape such as but not limited to round, circular, triangular, rhombus, square, trapezoid, or the like. In some embodiments, the present invention may provide that hotel wings may be radially placed (183) perhaps about 120 degrees apart from each other such as may be understood in FIG. 13. Two or even three wings may be placed about 120 degrees apart. In other embodiments, hotel wings may be centered (144) around center (145) of a hotel. Hotel wings may even be centered around a communal area (146) which may also be a social team area of a hotel.

Figure 13:
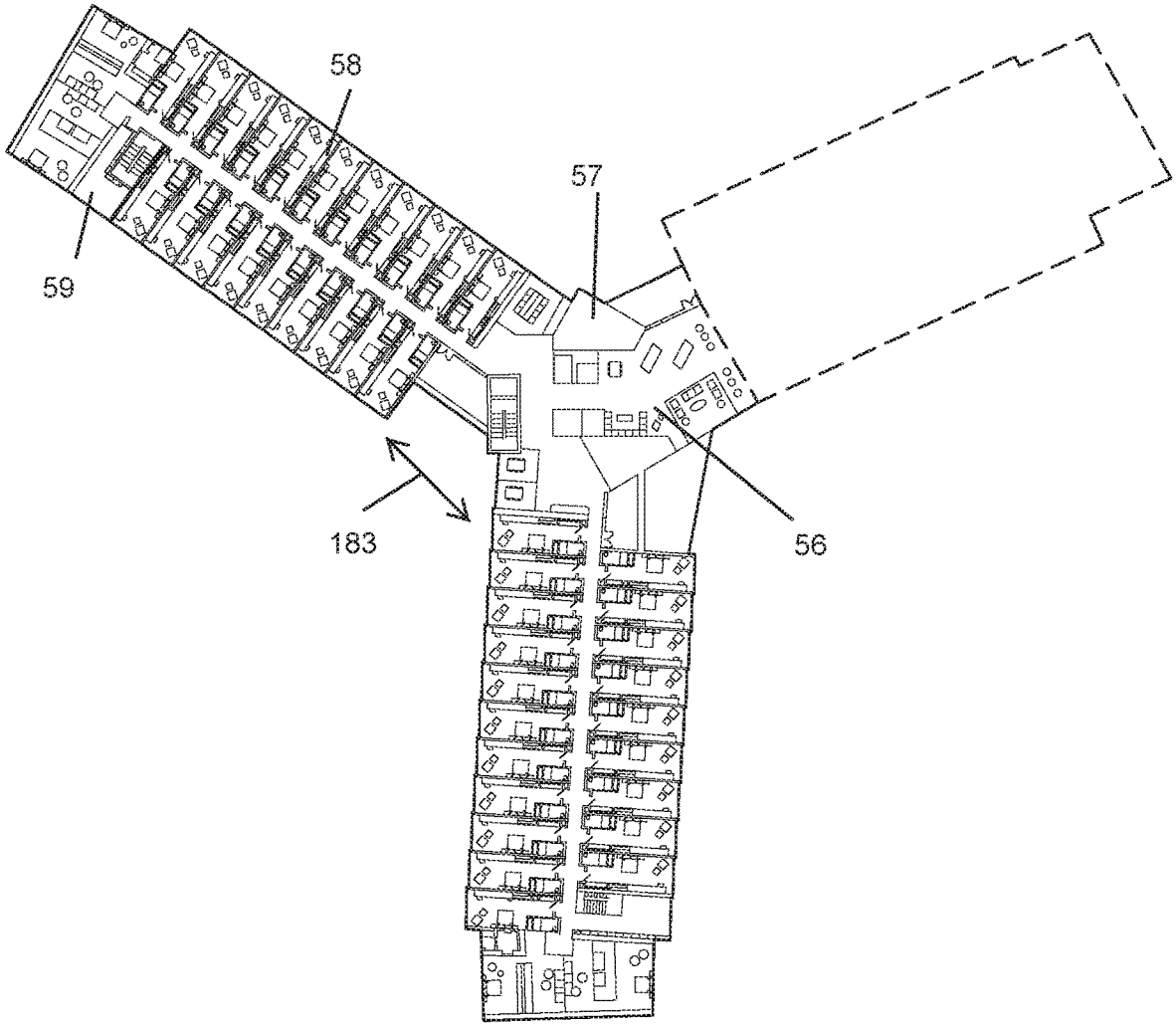
FIG. 13 is a non-limiting example of a lifestyle floor plan for a hotel system in accordance with some embodiments of the present invention.
Figure 14:
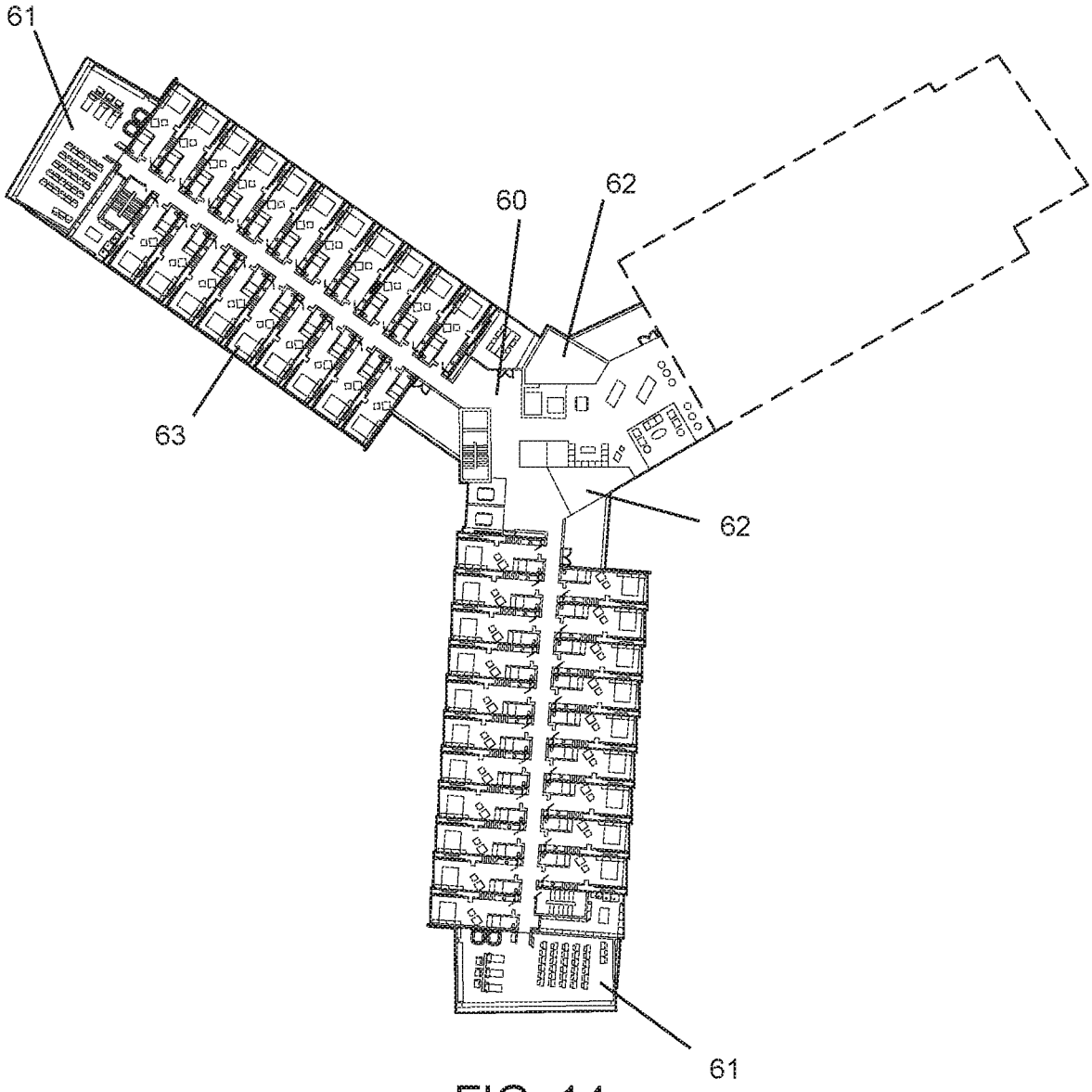
FIG. 14 is a non-limiting example of an elite player floor plan for a hotel system in accordance with some embodiments of the present invention.

FIG. 13 shows a non-limiting example of a lifestyle floor that may include, but is not limited to: a social space (56) a service area (57) guest rooms (58); a support area (59); any combination thereof; or the like. FIG. 14 shows a non-limiting ex ample of an elite player floor that may include, but is not limited to: a social space (60); a team space (61); a service area (62); elite player rooms (63); any combination thereof; or the like.

FIG. 15 shows an example of a secured hotel wing having a rectangular exterior shape with a first straight side (201), a second straight side (200), a first end, (202), and a second end (203). A first end room (206) may be at an end of a row of rooms and a second end room (204) may be at an end of a second row of rooms across a hallway. A team room (112) may have four sides, three of which may be exterior sides (205).

Figure 16:
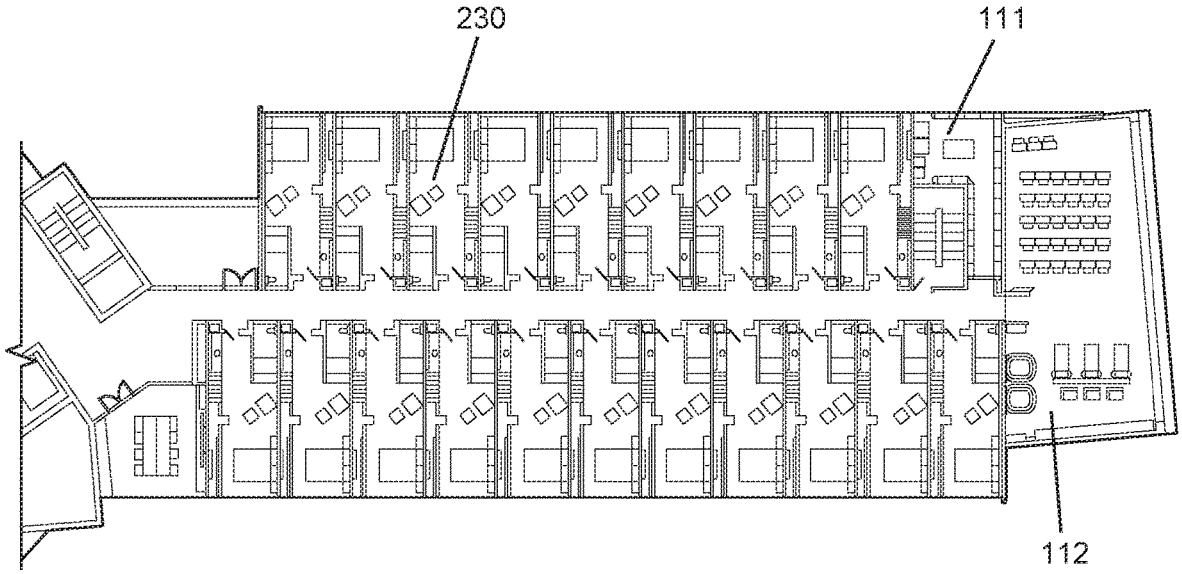
FIG. 16 is a non-limiting example of an elite player suite for a hotel system in accordance with some embodiments of the present invention.
Figure 17:
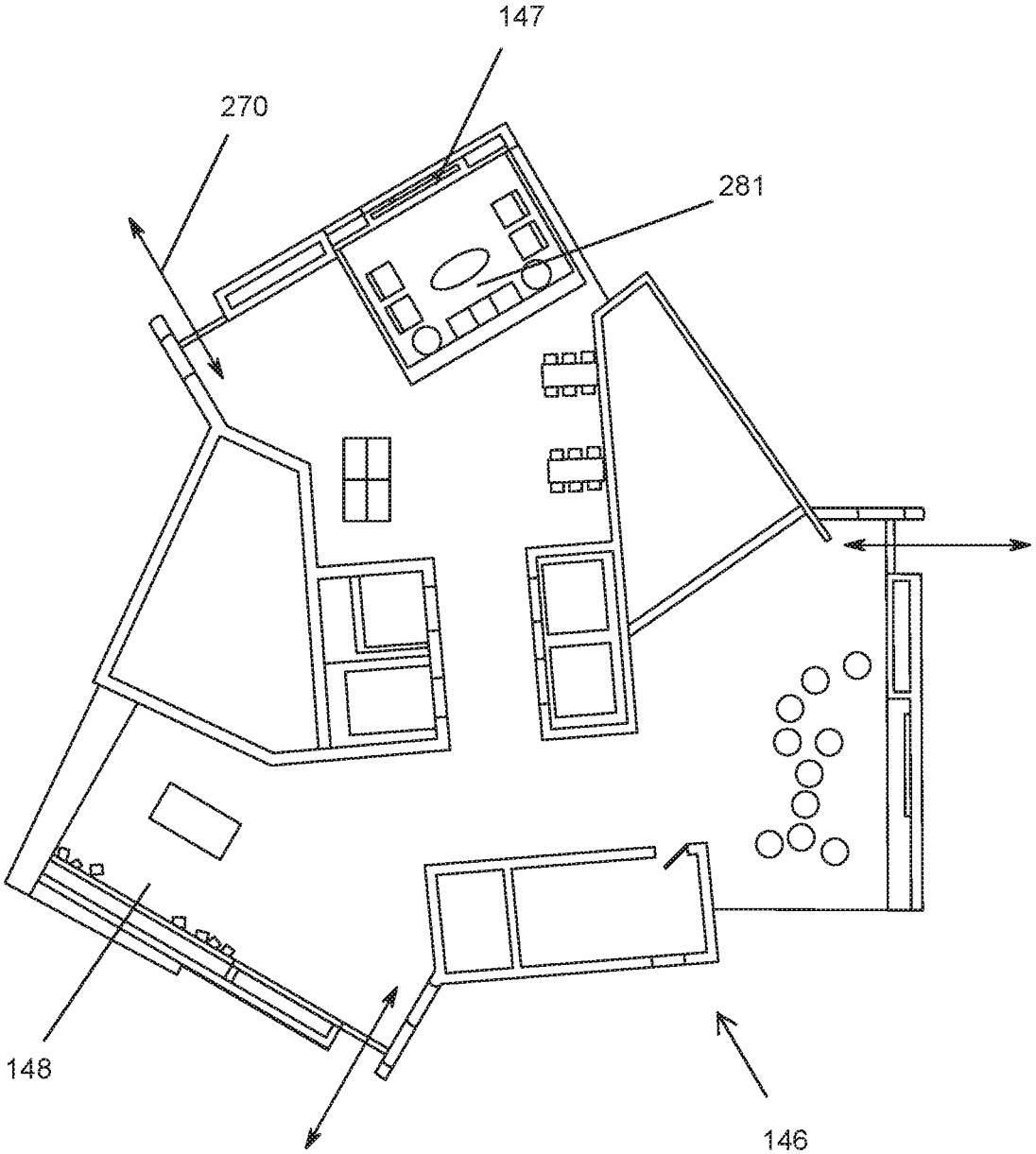
FIG. 17 is a non-limiting example of a social space for a hotel system in accordance with some embodiments of the present invention.

FIG. 16 provides a non-limiting example of an elite player suite layout which may provide larger player rooms (230), an equipment room (111) and perhaps even a team room (112). FIG. 17 shows a non-limiting example room design for a social space in a hotel system. In embodiments, the present invention may provide a social environment, such as to allow athletes or the like to connect with others. A social environment may be on each floor of a hotel system. Larger spaces may be available at lower levels, yet this area may be smaller and may allow for teams and athletes to mix without going into individual rooms. A social space may be a communal zone (146) which may also be considered a social team area. A communal zone may be located near a center (145) of a hotel perhaps even near at least one elevator (138). A floor may have two team suites per floor. A communal zone (146) may include but is not limited to at least one seating area (281), at least one television (147), at least one game area (148), or the like. A game area may include ping pong, pool, esports, or the like. A communal zone may provide access (270) to at least one wing, at least two wings, or perhaps even at least three wings or more.

In other embodiments, a floor may have one team suite per floor, may have two team suites per floor, may have three team suites per floor or more, or the like. Each suite may have player rooms (perhaps about 15, but it could be more or less), at least one head coach room, at least one coach room (perhaps about two coach rooms, or three coach rooms, or more), at least one team room, an equipment storage room, a team lounge room, or the like. A floor (141) may be multiple floors such as but not limited to five, eight, ten, between one and ten, or more floors.

Figure 18:
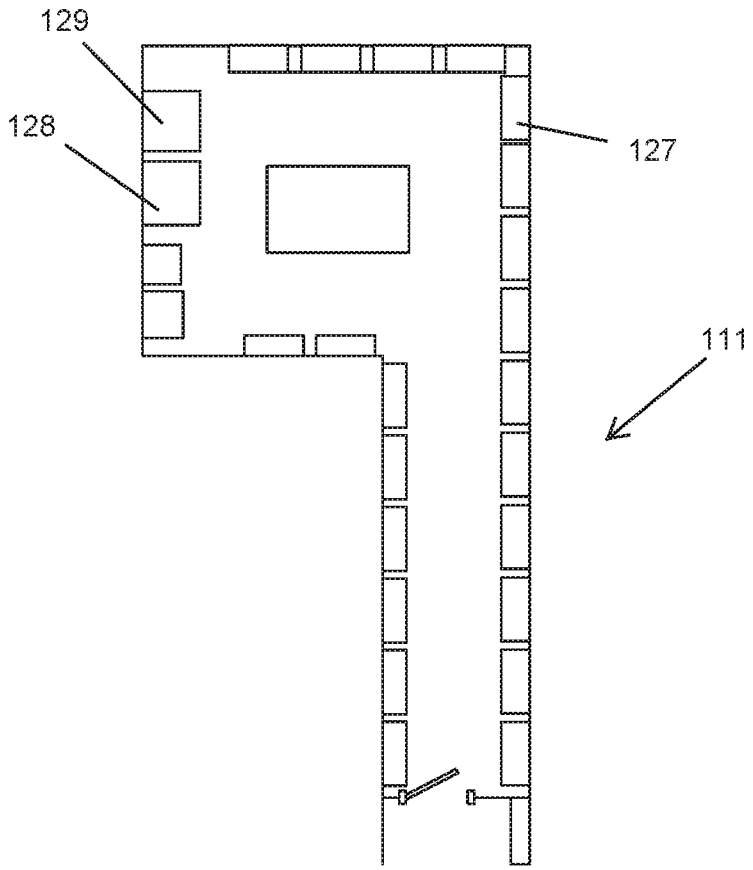
FIG. 18 is a non-limiting example of an equipment room for a hotel system in accordance with some embodiments of the present invention.

FIG. 18 shows a non-limiting example of an equipment room in a hotel. An equipment room (111) may be provided on each floor perhaps for each team. An equipment room may be configured to hold or even accommodate team equipment and uniforms perhaps to keep these clean. It may be a secure room which may even have lockers (127). It may also have domestic style washers (128) and dryers (129) that can be used by the teams so that they may look on point and like a team each day of their activities.

Figure 19:
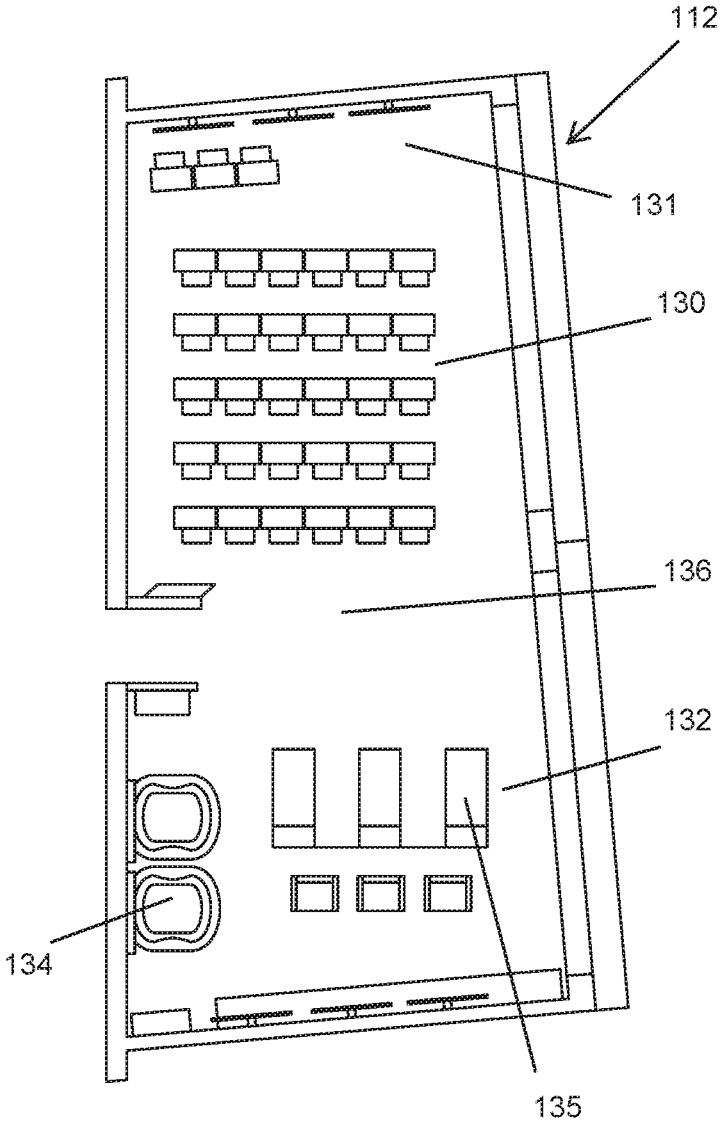
FIG. 19 is a non-limiting example of a team room for a hotel system in accordance with some embodiments of the present invention.
Figure 32:
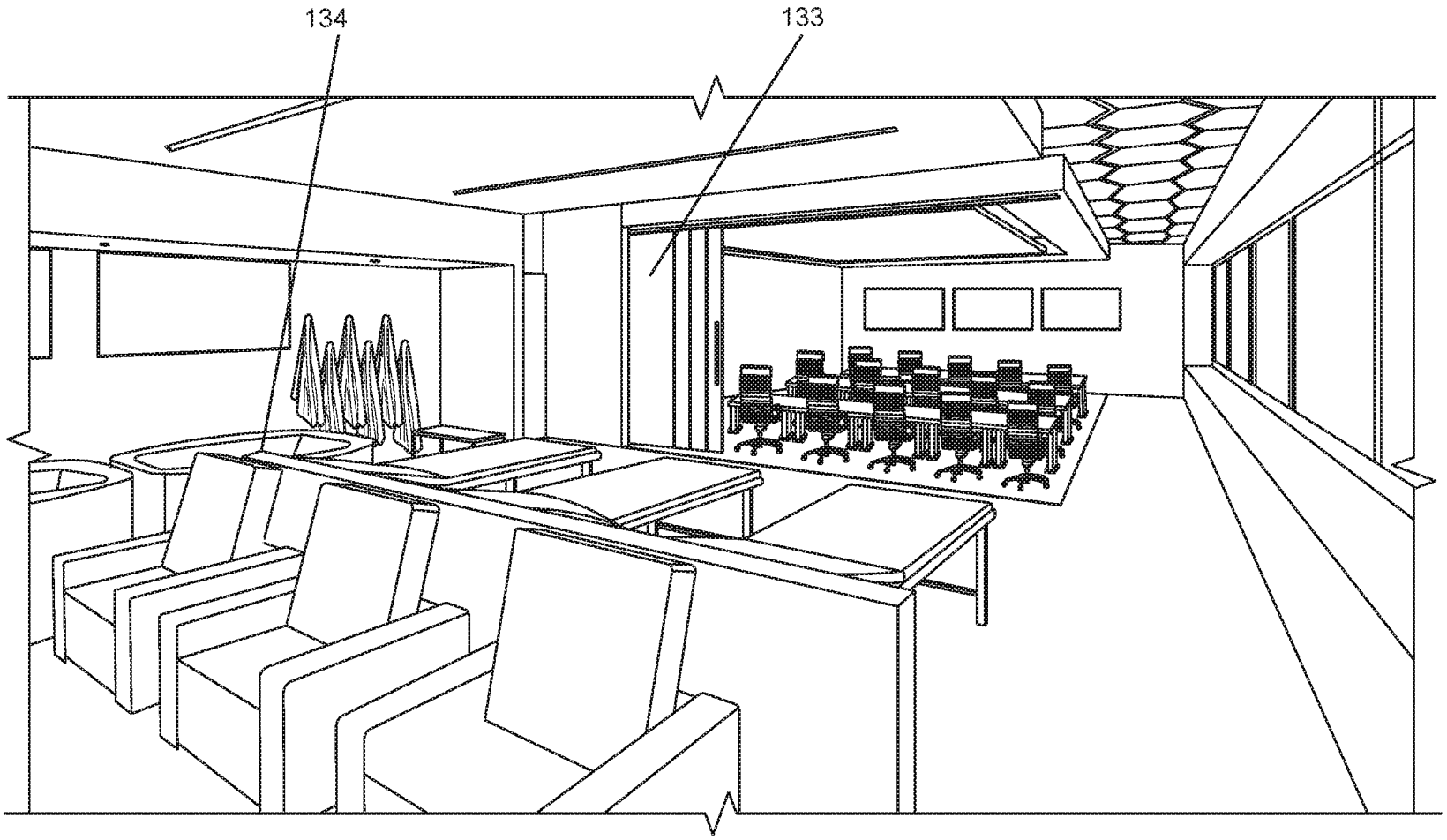
FIG. 32 is a non-limiting example of a team space for a hotel system in accordance with some embodiments of the present invention.
Figure 33:
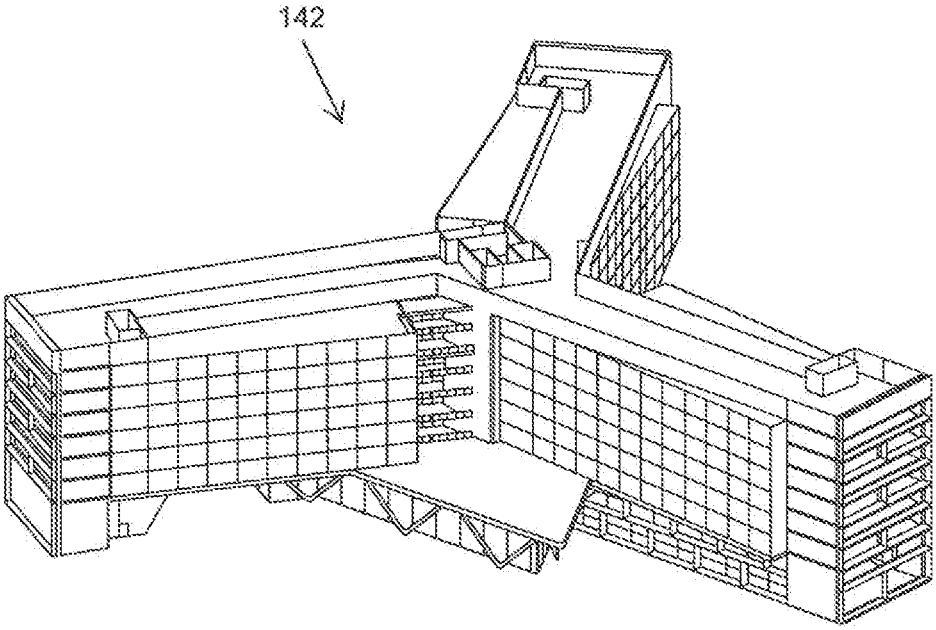
FIG. 33 is a non-limiting example of a hotel in accordance with some embodiments of the present invention.

FIG. 19 shows a non-limiting example of a team room which may provide the business end of the wing. FIG. 32 shows another non-limiting example of a team room of a hotel system. A team room may allow coaches to gather the athletes for review, tactical decisions and planning, review, or the like. A team room may include daily recovery and even daily preparation areas perhaps to allow the athletes to get additional care during a coaching presentation. This room alone may increase communication between players, coaches and physio's.

A team room (112) may be located in a hotel wing (102) perhaps on floor (141) of a hotel. A team room may include but is not limited to a meeting space (130), an audio visual area (131), and perhaps even a physical recovery area (132), or the like. A meeting space (130) and perhaps even an audio visual area (131) may be separatable (133) from a physical recovery area (132). It may be separated by a partition, door, divider, screen, obstruction, or the like and these may be movable, closable, openable, or the like. A physical recovery area may be open (136) to a meeting space and even an audio visual area perhaps so that any team member working on their physio can still participate in a team meeting or even review of film or the like. A physical recovery area may include at least one tub (134) and perhaps even at least one massage table (135). In some embodiments, a physical recovery room may have two or more tubs and may even have up to three or even more massage tables. A tub (134) may be a therapy tub that may provide ice baths or even hot baths.

Figure 20:
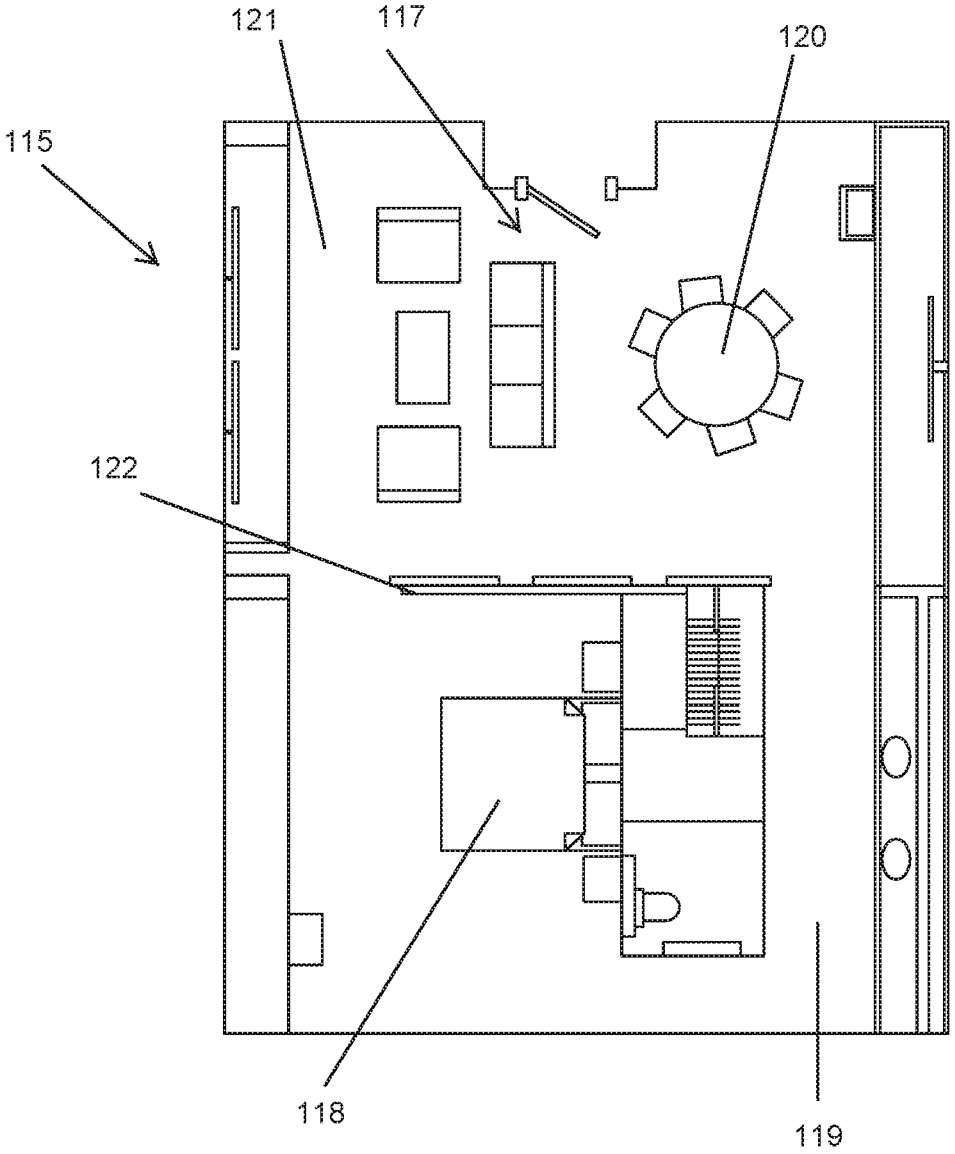
FIG. 20 is a non-limiting example of a head coach room for a hotel system in accordance with some embodiments of the present invention.

FIG. 20 shows a non-limiting example of a head coach room which may be, but is not limited to, located as the first room off of an elevator. This may provide a meeting space for the coaches perhaps with a separate conference table to accommodate the coaching staff that may be used before and after a competition. An audio visual area may be provided to review film that can be screened in a team room perhaps with the full team. A head coach room (115) may include, but is not limited to, a meeting space (117), a bed (118), and perhaps even a bathroom (119), or the like. A meeting space (117) may include, but is not limited to, a conference table (120) and perhaps even an audio visual area (121) which may include a seating area. A meeting space (117) may be separated (122) from a bed and even a bathroom. It may be separated by a partition, door, divider, screen, obstruction, or the like and these may be movable, closable, openable, or the like. A bed (118) perhaps in any of the rooms of a hotel may be a king bed, an oversized king bed, or the like. A head coach room may be bigger than a regular coach room such as an assistant coach room or the like.

Figure 21:
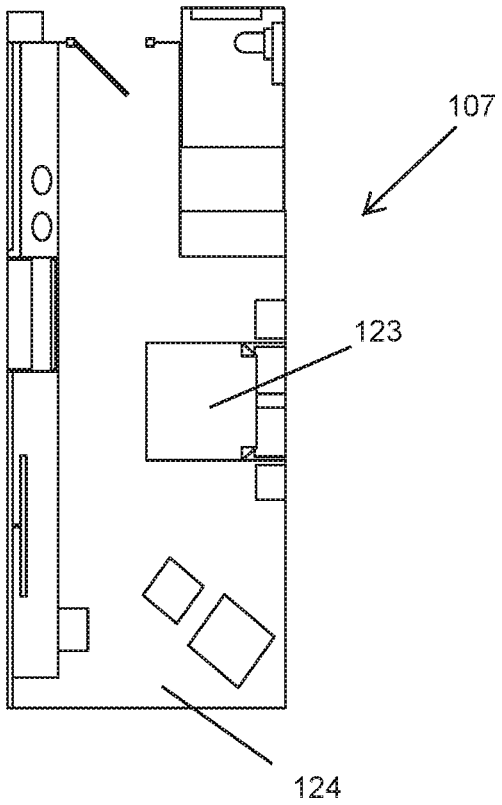
FIG. 21 is a non-limiting example of a coach room for a hotel system in accordance with some embodiments of the present invention.
Figure 22:
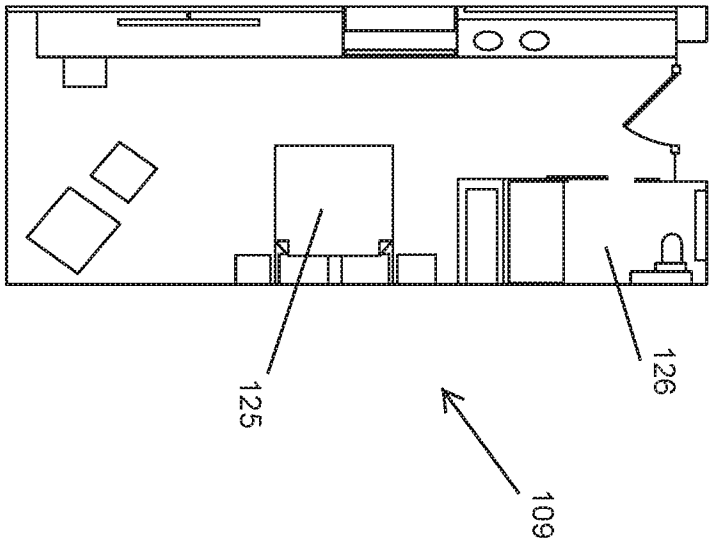
FIG. 22 is a non-limiting example of a single bed player room for a hotel system in accordance with some embodiments of the present invention.
Figure 23:
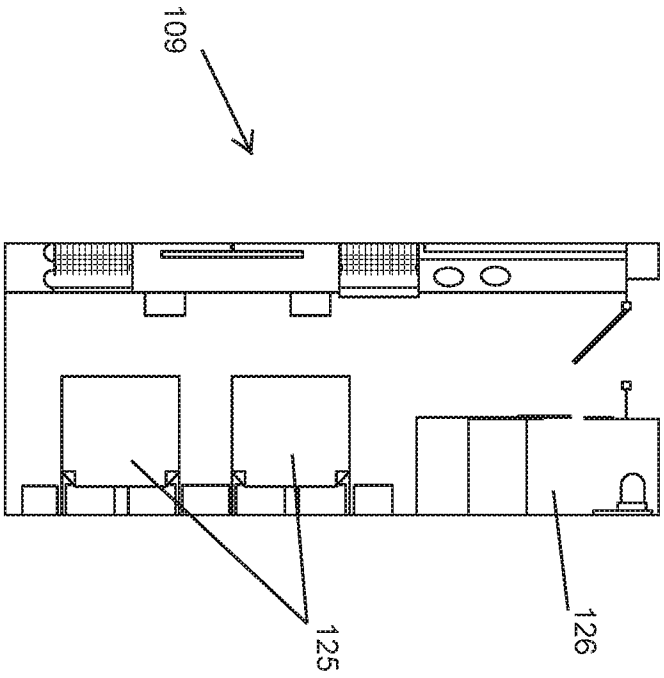
FIG. 23 is a non-limiting example of a double bed player room for a hotel system in accordance with some embodiments of the present invention.
Figure 24:
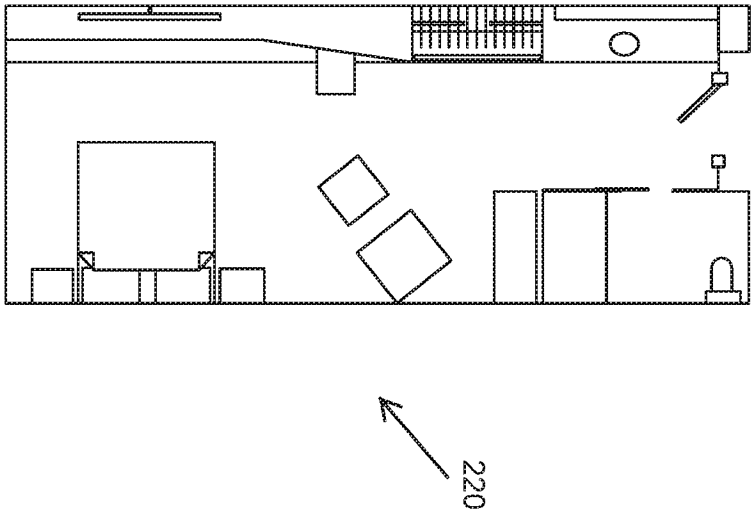
FIG. 24 is a non-limiting example of an elite player room for a hotel system in accordance with some embodiments of the present invention.

FIG. 21 shows a non-limiting example of a coach room (107), perhaps even an assistant coach room in some embodiments, which may feature a king bed (123), and even a reclining area (124) perhaps for film and even player planning. An assistant coach room may be used for coaches such as a team coordinator, a coach, a non-head coach, or the like. FIG. 22 shows a non-limiting example of a player room (109) which may have one bed (125), a bathroom area (126), or the like. FIG. 23 shows a non-limiting example of a player room (109) which may have two beds (125), perhaps even two king beds such as for team members that are sharing rooms, a bathroom (126), or the like. Single player rooms may be on the higher floors perhaps for luxury teams. A player room may be an elite player room (220). FIG. 24 provides a non-limiting example of an elite player room (220) which may be for elite or even professional players. It may include an oversized king bed and may even have upgraded finishes to add a level of luxury perhaps for a high level athlete traveling on an elite team.

Figure 25:
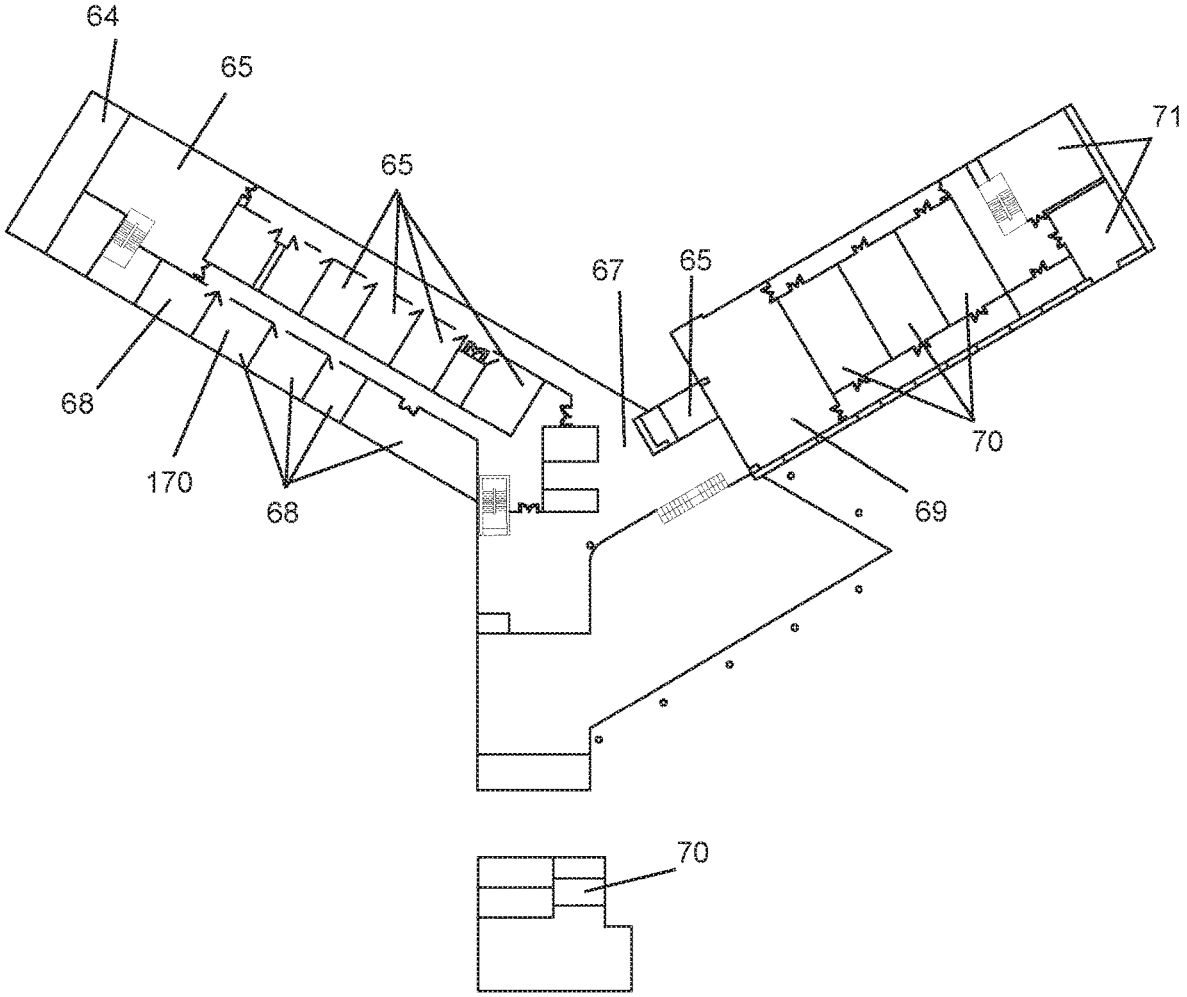
FIG. 25 is a non-limiting example of a second floor for a hotel system in accordance with some embodiments of the present invention.
Figure 35:
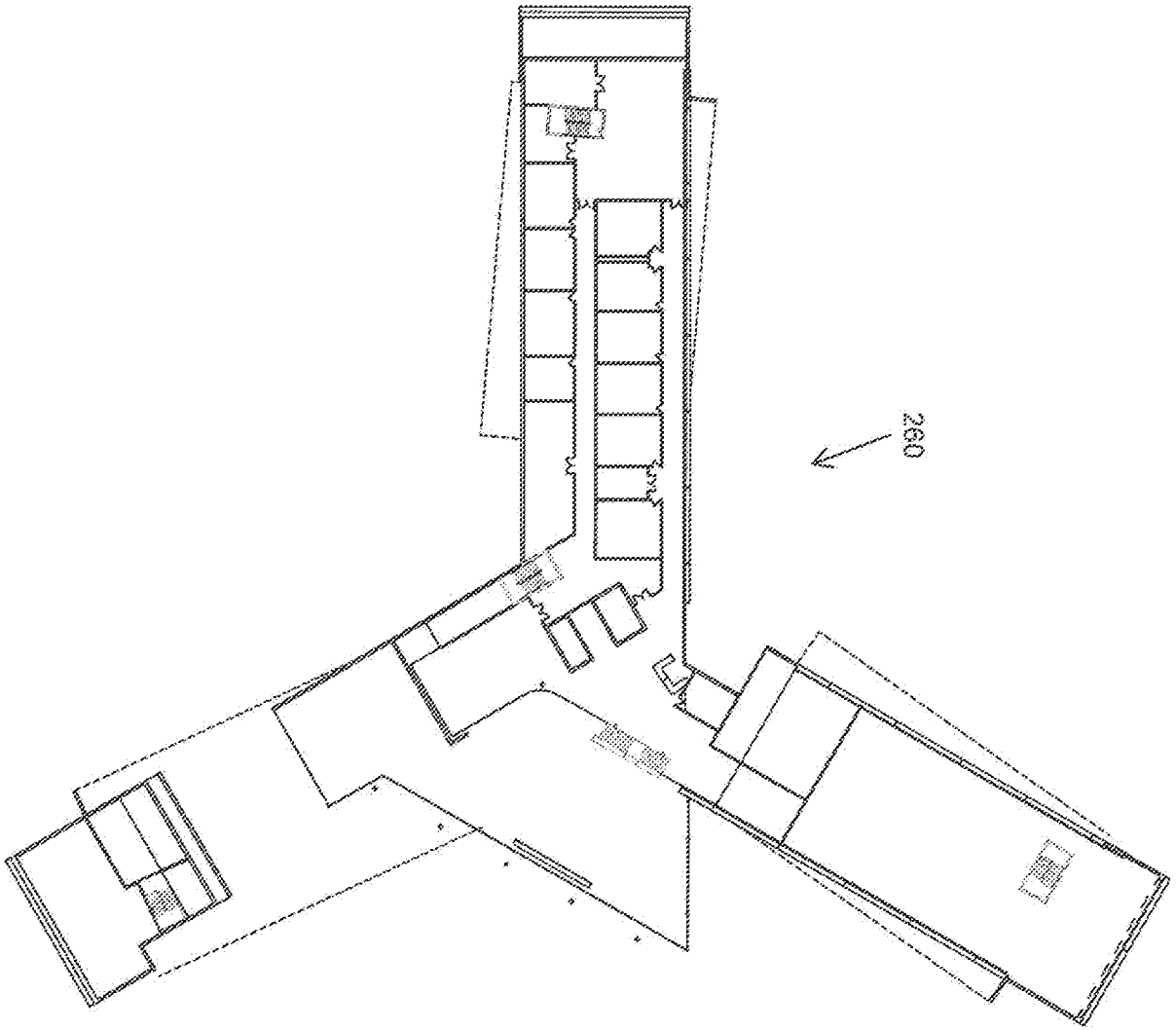
FIG. 35 is a non-limiting example of a recovery floor in accordance with some embodiments of the present invention.

FIGS. 25 and 35 show non-limiting examples of a recovery floor (260) of a hotel system in accordance with some embodiments of the present invention. A recovery floor may be on a second floor of a hotel. Part of the floor may be open to the floor below it, part may be a social area, part may be for service and part may even be for a recovery area. A recovery floor may include, but is not limited to: an open space (which may be an open space to below) (64); a recover space (65); a social space (67); a service area (68), (71); a pre-function area (69); meeting space (70); any combination thereof; or the like.

Figure 26:
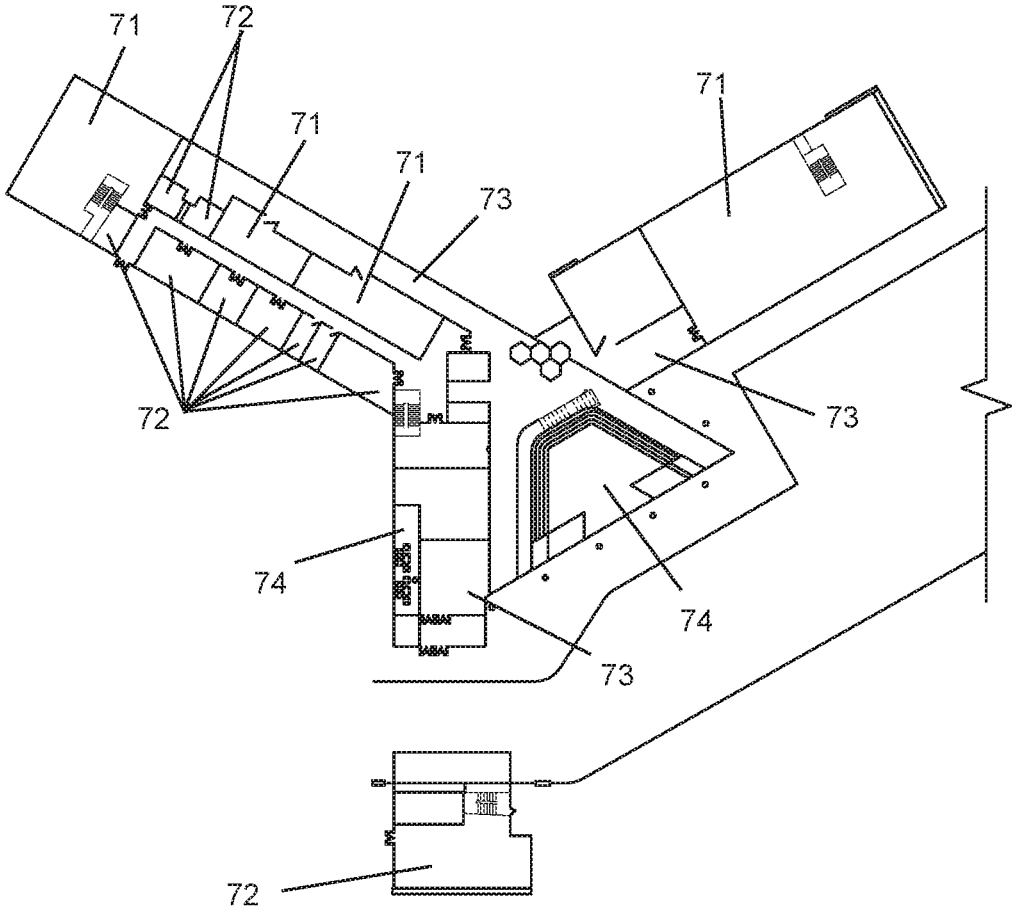
FIG. 26 is a non-limiting example of a ground floor for a hotel system in accordance with some embodiments of the present invention.
Figure 27:
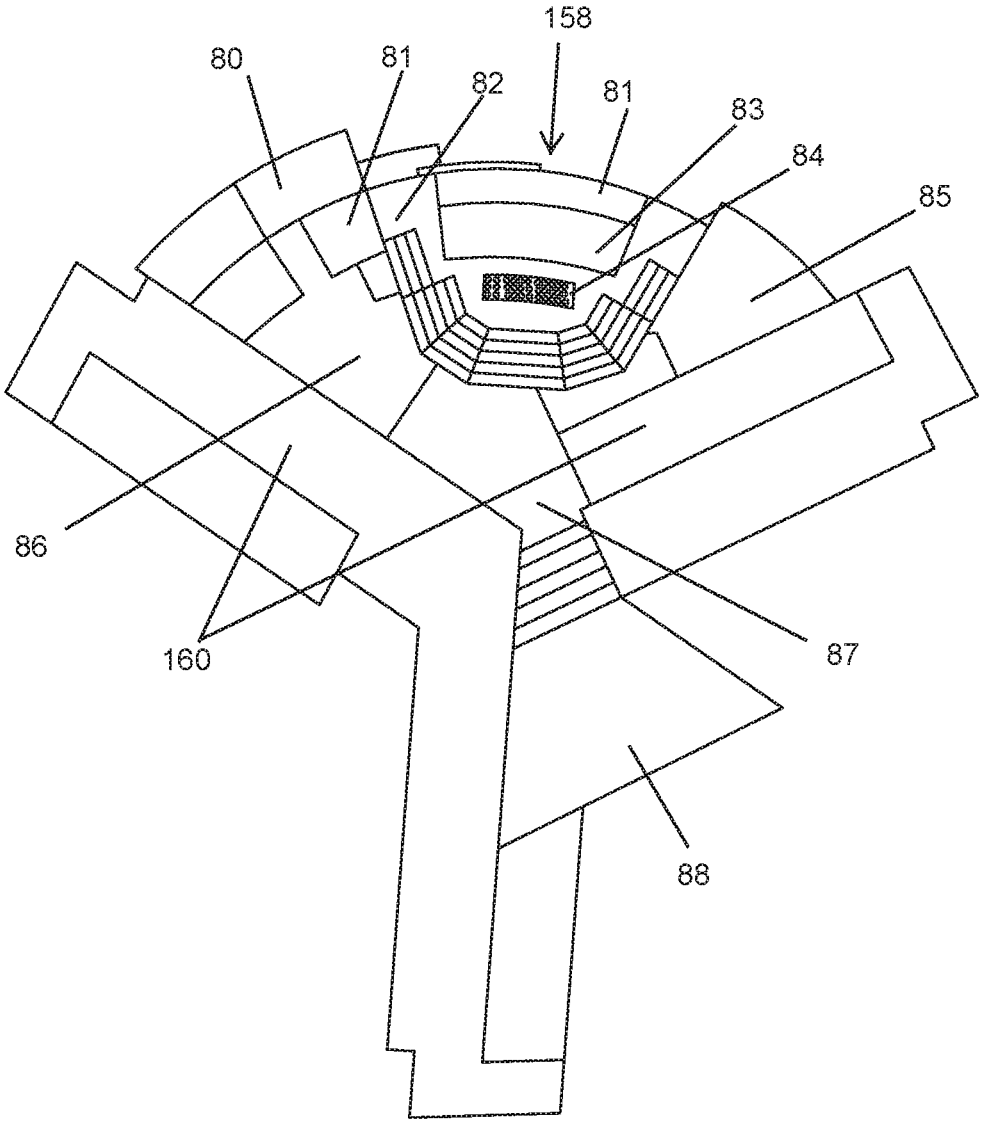
FIG. 27 is a non-limiting example of a floor plan for an esports arena for a hotel system in accordance with some embodiments of the present invention.
Figure 28:
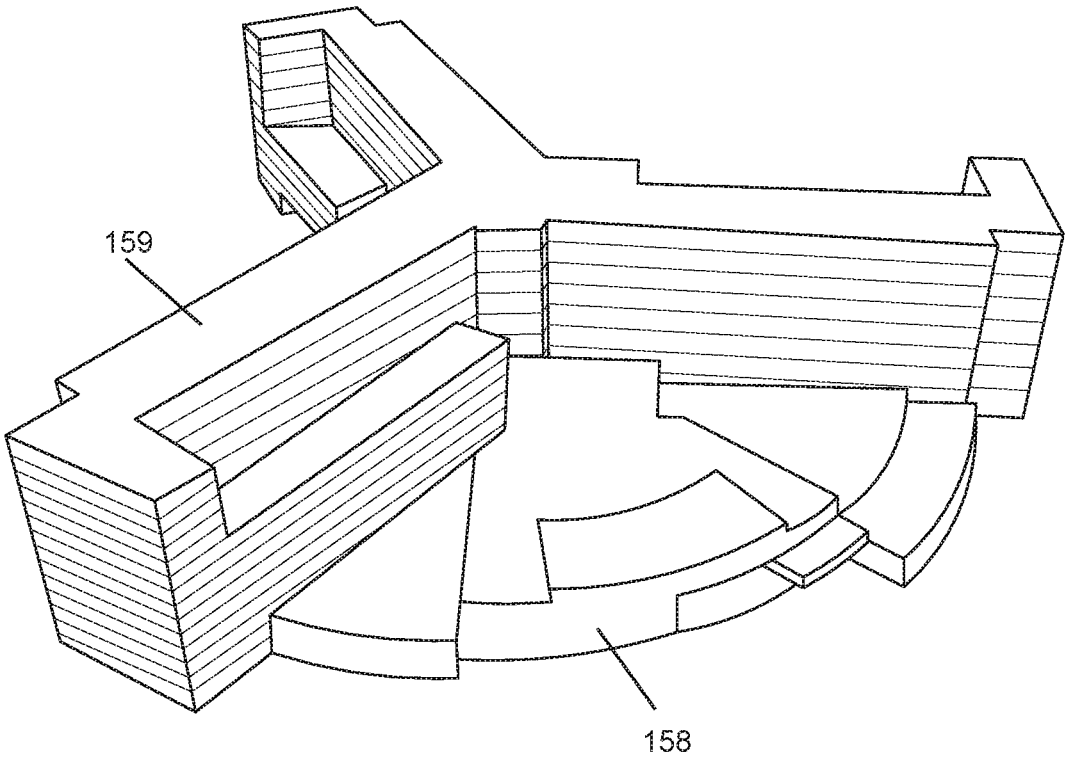
FIG. 28 is a non-limiting example of a conceptual massing for an esports arena for a hotel system in accordance with some embodiments of the present invention.
Figure 29:
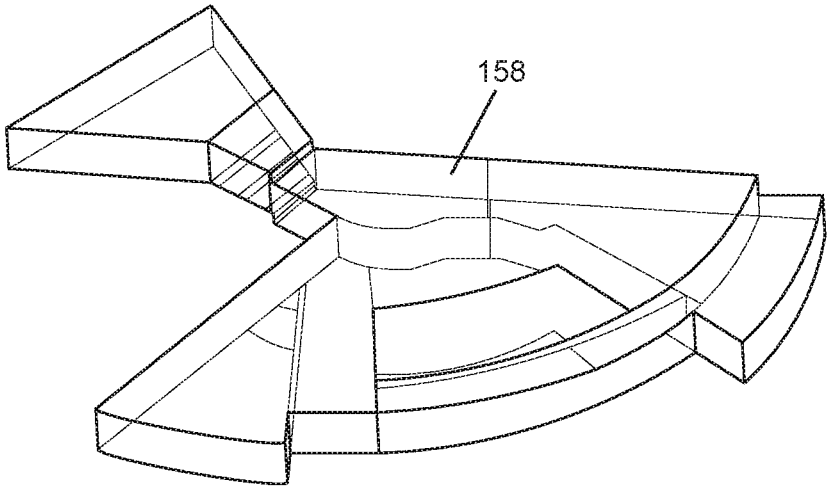
FIG. 29 is a non-limiting example of a conceptual program for an esports arena for a hotel system in accordance with some embodiments of the present invention.
Figure 36:
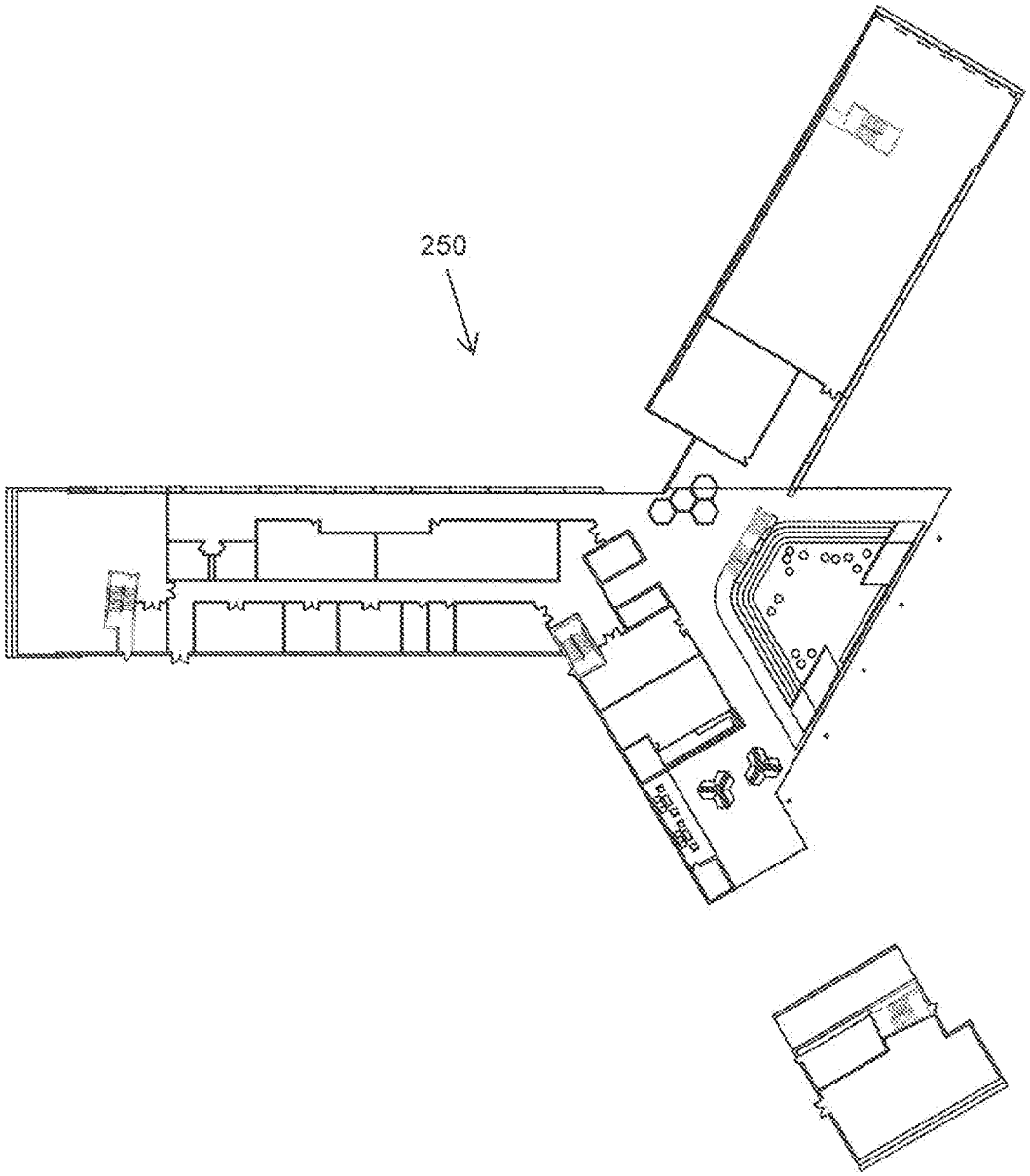
FIG. 36 is a non-limiting example of a ground floor in accordance with some embodiments of the present invention.

FIGS. 26 and 36 show non-limiting examples of a ground floor (250) of a hotel system in accordance with some embodiments of the present invention. Part of the floor may be for refueling and connecting, such as with restaurants, food options, vending machines, and the like, part may be for social aspects, part may be the lobby, part may be for service, or the like. A ground floor, or even any floor of a hotel system may include, but is not limited to, a lobby, lounge, front desk, luggage/valet, sports retail, sports kiosks, restaurants, staff work rooms and offices, ack of house services and support, or the like. A ground floor may include, but is not limited to: a refuel and even connect area (71); a service area (72); a social area (73); a lobby (74); any combination thereof; or the like.

FIGS. 27-30 show non-limiting examples of an electronic-sports arena (158) which may include but is not limited to: a lounge (80); a service area/station (81); a stadium seating (82) which may include about 405 general seats; a stage (83); a virtual reality floor seating (84) which may include about 30 virtual reality seats; a virtual reality gym (85); an exhibit or even a concessions section (86); an entrance hall (87); a lobby (88); any combination thereof; or the like.

E-sports may be at a forefront of the sports market spending segment. E-sports may include an Overwatch eSports league, a "League of Legends" eSports competition, an ESL Extreme Masters event, or the like. In some embodiments, the present invention may provide an about 3,000 square foot multi-functional space that can be used for gaming competitions within an e-sports arena perhaps as well as corporate events, movies and even live entertainment, or the like. Rooms in a hotel perhaps near a dedicated gaming venue may be equipped with gigabyte ethernet connections and perhaps even lightning fast wi-fi.

Figure 30:
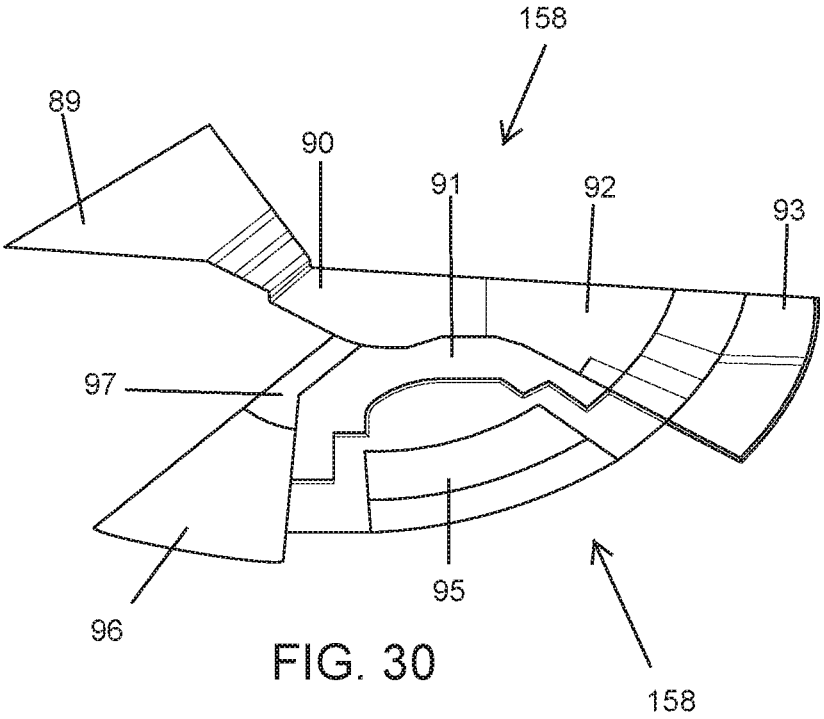
FIG. 30 is a non-limiting example of an esports arena for a hotel system in accordance with some embodiments of the present invention.

As may be understood from FIG. 30, an electronic sports arena (158) may include, but is not limited to: a lobby (89); an entrance hall (90); stadium seating (91); an exhibit or even a concessions section (92); a lounge (93); a stage (95); a virtual reality gym (96); a VIP section/area (97); any combination thereof; or the like. An electronic-sports arena (158) may be attached to a hotel (159) and may even be located between two wings (160) of a hotel. An electronic-sports arena may be configured to accommodate gaming competitions, may be about 300 square feet, or the like. Stadium seating may include about 405 general seats and virtual reality seating may include about 30 seats; however, any quantity of seats may be used.

Figure 31:
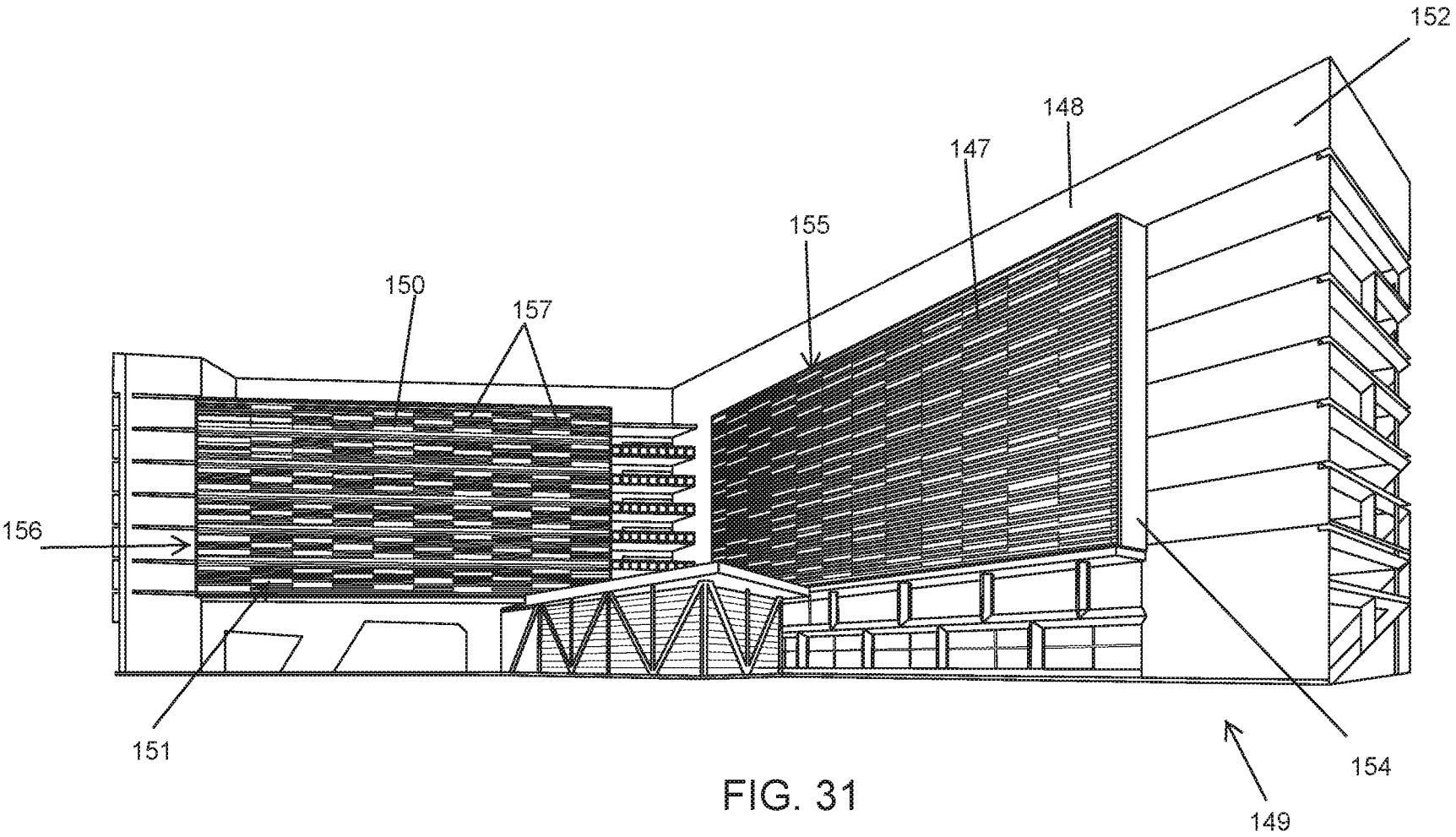
FIG. 31 is a non-limiting example of an exterior for a hotel system in accordance with some embodiments of the present invention.

FIG. 31 shows a non-limiting example of an exterior of a hotel. A hotel building exterior may include, but is not limited to, a large-scale rectangular projection (147) on a front (148) of a building (149). A plurality of patterned rectangular motif structures (150) may be on said large-scale rectangular projection and may create a pattern (151) on a projection. In some embodiments, a plurality of patterned rectangular motif structures (150) may be located on any part of a building. A large-scale rectangular projection may cover an amount of a front of a building including but not limited to at least about 50%, at least about 60%, at least about 70%, at least about 80%, at least about 90% of a front of a building, or the like. In some embodiments, a front of a building may include a front of at least one wing (152) perhaps of a multiple winged hotel. A large-scale rectangular projection may be configured to at least partially project out (154) from a front of a building. A plurality of patterned rectangular motif structures may be colored. This may include any color and the color may be part of a pattern. Colored patterned rectangular motif structures may be configured to change colors such as manually, automatically, via a computer program, or the like in changing of colors. A pattern may include but is not limited to making at least one vertical pattern (155), at least one horizonal pattern (156), at least one horizonal pattern and at least one vertical pattern, or the like. A pattern (151) such as a horizontal or even a vertical pattern, may be repeated (157) within the large-scale rectangular projection. A pattern may be a design, configuration, or the like utilizing rectangular motif structures. This may include individual sizing, colors, shapes, depth, or the like to a structure. While some embodiments provide rectangular structures, any shape or design, including non-rectangular structures, may be used. Rectangular motif structures may be a recurring theme, may be distinctive, or the like.

While the invention has been described in connection with some preferred embodiments, it is not intended to limit the scope of the invention to the particular form set forth, but on the contrary, it is intended to cover such alternatives, modifications, and equivalents as may be included within the spirit and scope of the invention as defined by the statements of inventions. Examples of alternative claims as clauses may include:

1. A hotel team suite comprising:
   a secured hotel wing comprising a hallway and a plurality of rooms located on each side of said hallway;
   a single door entry into said secured hotel wing;
   wherein said plurality of rooms comprises:
      a coach room on each side of said hallway and located next to said single door entry;
      up to about eight player rooms on each side of said hallway sequentially located next to each of said coach room;
      a second coach room on each side of said hallway located next to said up to about eight player rooms; and
      an equipment room located on one side of said hallway after one of said second coach room; and
   a team room located at an end of said secured hotel wing next to said equipment room on one side of said hallway and next to said second coach room on an other side of said hallway.
2. The hotel team suite as described in clause 1 or any other clause wherein said coach room on each side of said hallway located next to said single door entry comprises a head coach room on one side and an assistant coach room on the other side of said hallway.
3. The hotel team suite as described in clause 1 or any other clause wherein said second coach room comprises an assistant coach room.
4. The hotel team suite as described in clause 2 or any other clause wherein said head coach room comprises a meeting space, bed, and bathroom for a head coach of a team.
5. The hotel team suite as described in clause 4 or any other clause wherein said meeting space in said head coach room comprises a conference table and an audio visual area.
6. The hotel team suite as described in clause 4 or any other clause wherein said meeting space is separated from said bed and bathroom in said head coach room.
7. The hotel team suite as described in clause 4 or any other clause wherein said bed comprises a king bed.
8. The hotel team suite as described in clause 2 or 3 or any other clause wherein said assistant coach room comprises a king bed and a reclining area for an assistant coach.
9. The hotel team suite as described in clause 8 or any other clause wherein said assistant coach comprises a coach selected from a group consisting of a team coordinator, a coach, and a non-head coach.
10. The hotel team suite as described in clause 1 or any other clause wherein said player room comprises two beds and a bathroom.
11. The hotel team suite as described in clause 1 or any other clause wherein said player room comprises one bed and a bathroom.
12. The hotel team suite as described in clause 10 or 11 or any other clause wherein said bed comprises a king bed.
13. The hotel team suite as described in clause 10 or 11 or any other clause wherein said bed comprises an oversized king bed.
14. The hotel team suite as described in clause 1 or any other clause wherein said equipment room comprises a room configured to hold team equipment and uniforms.
15. The hotel team suite as described in clause 1 or any other clause wherein said equipment room comprises lockers, washer, and a dryer.

16. The hotel team suite as described in clause 1 or any other clause wherein said team room comprises a meeting space, an audio visual area, and a physical recovery area.
17. The hotel team suite as described in clause 16 or any other clause wherein said meeting space and said audio visual area are separatable from said physical recovery area.
18. The hotel team suite as described in clause 16 or any other clause wherein said physical recovery area comprises at least one tub and at least one massage table.
19. The hotel team suite as described in clause 16 or any other clause wherein said physical recovery area is open to said meeting space and said audio visual area.
20. The hotel team suite as described in clause 18 or any other clause wherein said physical recovery area comprises two tubs and three massage tables.
21. The hotel team suite as described in clause 18 or any other clause wherein said at least one tub comprises a therapy tub.
22. The hotel team suite as described in clause 1 or any other clause wherein said team room is parallel to said equipment room and said second coach room.
23. The hotel team suite as described in clause 1 or any other clause wherein said team room is located at one end of said secured hotel wing.
24. The hotel team suite as described in clause 1 or any other clause wherein said team room is larger than said equipment room and said second coach room.
25. The hotel team suite as described in clause 1 or any other clause wherein said team room is adjacent to said equipment room and said second coach room.
26. The hotel team suite as described in clause 1 or any other clause wherein said single door entry is located near an elevator.
27. The hotel team suite as described in clause 1 or any other clause wherein said single door entry is located at one end of said secured hotel wing.
28. The hotel team suite as described in clause 1 or any other clause wherein said coach room on each side of said hallway located next to said single door entry comprises each of said coach room located across from each other.
29. The hotel team suite as described in clause 1 or any other clause wherein said up to about eight player rooms on each side of said hallway sequentially located next each of said coach room comprises seven player rooms on one side of a hallway and eight player rooms located on another side of said hallway.
30. The hotel team suite as described in clause 29 or any other clause wherein one of said coach rooms comprises an assistant coach room and wherein said seven player rooms on one side of a hallway are located next to said assistant coach room.
31. The hotel team suite as described in clause 29 or any other clause wherein one of said coach rooms comprises a head coach room and wherein said eight player rooms on one side of a hallway are located next to said head coach room.
32. The hotel team suite as described in clause 2 or any other clause wherein said head coach room is bigger than said assistant coach room.
33. The hotel team suite as described in clause 1 or any other clause wherein said secured hotel wing comprises two secured hotel wings on a floor of a hotel.
34. The hotel team suite as described in clause 1 or any other clause wherein said secured hotel wing comprises three secured hotel wings on a floor of a hotel.
35. The hotel team suite as described in clause 1 or any other clause wherein said secured hotel wing is located on at least one floor of a hotel.
36. The hotel team suite as described in clause 1 or any other clause wherein said secured hotel wing comprises a substantially rectangular shape.
37. The hotel team suite as described in clause 33 or any other clause wherein said two secured hotel wings are radially placed about 120 degrees apart from each other.
38. The hotel team suite as described in clause 34 or any other clause wherein said three secured hotel wings are radially placed about 120 degrees apart from each other.
39. The hotel team suite as described in clause 33 or 34 or any other clause wherein said secured hotel wings are centered around a social team area.
40. The hotel team suite as described in clause 39 or any other clause wherein said social team area is located near a center of a hotel building.
41. The hotel team suite as described in clause 40 or any other clause wherein said social team area is located near at least one elevator of a hotel building.
42. The hotel team suite as described in clause 35 or any other clause wherein said at least one floor comprises multiple floors.
43. The hotel team suite as described in clause 35 or any other clause wherein said at least one floor is selected from a group consisting of five floors of said hotel; eight floors of said hotel; and ten floors of said hotel.
44. The hotel team suite as described in clause 35 or any other clause wherein said hotel comprises a room capacity of 90 rooms, 180 rooms, and 360 rooms.
45. A hotel comprising a team room located in a hotel wing on a floor of said hotel, wherein said team room comprises a meeting space, an audio visual area, and a physical recovery area.
46. The hotel as described in clause 45 or any other clause wherein said team room comprises a secured team room.
47. The hotel as described in clause 46 or any other clause wherein said secured team room is accessible only by guests staying in rooms in said hotel wing.
48. The hotel as described in clause 45 or any other clause wherein said meeting space and said audio visual area are separatable from said physical recovery area.
49. The hotel as described in clause 45 or any other clause wherein said physical recovery area comprises at least one tub and at least one massage table.
50. The hotel as described in clause 45 or any other clause wherein said physical recovery area is open to said meeting space and said audio visual area.
51. The hotel as described in clause 49 or any other clause wherein said physical recovery area comprises two tubs and three massage tables.
52. The hotel as described in clause 49 or any other clause wherein said at least one tub comprises a therapy tub.
53. The hotel as described in clause 45 or any other clause wherein said team room is located at an end of said hotel wing.
54. The hotel as described in clause 45 or any other clause wherein said hotel wing comprises a secured hotel wing.

55. The hotel as described in clause 54 or any other clause wherein said secured hotel wing comprises a single door entry into said secured hotel wing.
56. The hotel as described in clause 45 or any other clause wherein said hotel wing comprises a hallway and a plurality of rooms located on each side of said hallway.
57. The hotel as described in clause 45 or any other clause wherein said hotel wing comprises two hotel wings on a floor of a hotel.
58. The hotel as described in clause 45 or any other clause wherein said hotel wing comprises three hotel wings on a floor of a hotel.
59. The hotel as described in clause 45 or any other clause wherein said hotel wing is located on at least one floor of a hotel.
60. The hotel as described in clause 45 or any other clause wherein said hotel wing comprises a substantially rectangular shape.
61. The hotel as described in clause 57 or any other clause wherein said two hotel wings are radially placed about 120 degrees apart from each other.
62. The hotel as described in clause 58 or any other clause wherein said three hotel wings are radially placed about 120 degrees apart from each other.
63. The hotel as described in clause 57 or 58 or any other clause wherein said hotel wings are centered around a social team area.
64. The hotel as described in clause 63 or any other clause wherein said social team area is located near a center of a hotel building.
65. The hotel as described in clause 63 or any other clause wherein said social team area is located near at least one elevator of a hotel building.
66. The hotel as described in clause 56 or any other clause wherein said plurality of rooms located on each side of said hallway comprises a coach room on each side of said hallway and each located next to said single door entry.
67. The hotel as described in clause 66 or any other clause wherein said coach room on each side of said hallway comprises a head coach room on one side and an assistant coach room on an other side of said hallway.
68. The hotel as described in clause 67 or any other clause wherein said head coach room comprises a meeting space, bed, and bathroom for a head coach of a team.
69. The hotel as described in clause 68 or any other clause wherein said meeting space in said head coach room comprises a conference table and an audio visual area.
70. The hotel as described in clause 68 or any other clause wherein said meeting space is separated from said bed and bathroom in said head coach room.
71. The hotel as described in clause 68 or any other clause wherein said bed comprises a king bed.
72. The hotel as described in clause 45 or any other clause wherein said hotel wing comprises player rooms.
73. The hotel as described in clause 66 or any other clause wherein said plurality of rooms located on each side of said hallway comprises up to about eight player rooms on each side of said hallway sequentially located next to each of said coach room.
74. The hotel as described in clause 73 or any other clause wherein said plurality of rooms located on each side of said hallway comprises a second coach room on each side of said hallway located next to said up to about eight player rooms.
75. The hotel as described in clause 72 or 73 or any other clause wherein said player room comprises two beds and a bathroom.
76. The hotel as described in clause 72 or 73 or any other clause wherein said player room comprises one bed and a bathroom.
77. The hotel as described in clause 75 or any other clause wherein said bed comprises a king bed.
78. The hotel as described in clause 75 or any other clause wherein said bed comprises an oversized king bed.
79. The hotel as described in clause 73 or any other clause wherein said up to about eight player rooms on each side of said hallway sequentially located next each of said coach room comprises seven player rooms on one side of a hallway and eight player rooms located on another side of said hallway.
80. The hotel as described in clause 79 or any other clause wherein one of said coach rooms comprises an assistant coach room and wherein said seven player rooms on one side of a hallway are located next to said assistant coach room.
81. The hotel as described in clause 79 or any other clause wherein one of said coach rooms comprises a head coach room and wherein said eight player rooms on one side of a hallway are located next to said head coach room.
82. The hotel as described in clause 67 or any other clause wherein said head coach room is bigger than said assistant coach room.
83. The hotel as described in clause 45 or any other clause and further comprising an equipment room in said hotel wing.
84. The hotel as described in clause 45 or any other clause and further comprising an equipment room located on one side of said hallway after said second coach room.
85. The hotel as described in clause 84 or any other clause wherein said team room is parallel to said equipment room and said second coach room.
86. The hotel as described in clause 83 or any other clause wherein said equipment room comprises a room configured to hold team equipment and uniforms.
87. The hotel as described in clause 83 or any other clause wherein said equipment room comprises lockers, washer, and a dryer.
88. The hotel as described in clause 67 or any other clause wherein said assistant coach room comprises a king bed and a reclining area for an assistant coach.
89. The hotel as described in clause 88 or any other clause wherein said assistant coach comprises a coach selected from a group consisting of a team coordinator, a coach, and a non-head coach.
90. The hotel as described in clause 59 or any other clause wherein said at least one floor comprises multiple floors.
91. The hotel as described in clause 59 or any other clause wherein said at least one floor is selected from a group consisting of five floors of said hotel; eight floors of said hotel; and ten floors of said hotel.
92. The hotel as described in clause 1 or any other clause wherein said hotel comprises a room capacity of 90 rooms, 180 rooms, and 360 rooms.
93. A sports hotel team social space comprising:
at least one floor of a hotel having at least one wing; and
a communal zone near said at least one wing and located near an elevator of said hotel.

94. The sports hotel team social space as described in clause 93 or any other clause wherein said communal zone is located near a center of said hotel.
95. The sports hotel team social space as described in clause 93 or any other clause wherein said at least one wing comprises at least one secured wing.
96. The sports hotel team social space as described in clause 93 or any other clause wherein said at least one wing comprises two wings on a floor of said hotel
97. The sports hotel team social space as described in clause 93 or any other clause wherein said at least one wing comprises three wings on a floor of said hotel
98. The sports hotel team social space as described in clause 93 or any other clause wherein said at least one wing comprises a substantially rectangular shape
99. The sports hotel team social space as described in clause 96 or any other clause wherein said two wings on said floor of said hotel are radially placed about 120 degrees apart from each other.
100. The sports hotel team social space as described in clause 97 or any other clause wherein said three wings on said floor of said hotel are radially placed about 120 degrees apart from each other.
101. The sports hotel team social space as described in clause 96 or any other clause wherein said wings are centered around said communal zone.
102. The sports hotel team social space as described in clause 93 or any other clause wherein said communal zone comprises at least one seating area, at least one television, and at least one game area.
103. The sports hotel team social space as described in clause 95 or any other clause wherein said at least one secured wing comprises a single door entry to a secured wing.
104. The sports hotel team social space as described in clause 93 or any other clause wherein said at least one wing comprises a hallway and a plurality of rooms located on each side of said hallway.
105. The sports hotel team social space as described in clause 104 or any other clause wherein said plurality of rooms comprises a team room.
106. The sports hotel team social space as described in clause 105 or any other clause wherein said team room comprises a meeting space, an audio visual area, and a physical recovery area.
107. The sports hotel team social space as described in clause 106 or any other clause wherein said meeting space and said audio visual area are separatable from said physical recovery area.
108. The sports hotel team social space as described in clause 106 or any other clause wherein said physical recovery area comprises at least one tub and at least one massage table.
109. The sports hotel team social space as described in clause 106 or any other clause wherein said physical recovery area is open to said meeting space and said audio visual area.
110. The sports hotel team social space as described in clause 106 or any other clause wherein said physical recovery area comprises two tubs and three massage tables.
111. The sports hotel team social space as described in clause 108 or any other clause wherein said at least one tub comprises a therapy tub.
112. The sports hotel team social space as described in clause 105 or any other clause wherein said team room is located at an end of said hotel wing.
113. The sports hotel team social space as described in clause 104 or any other clause wherein said plurality of rooms located on each side of said hallway comprises a coach room on each side of said hallway and each located next to a single door entry.
114. The sports hotel team social space as described in clause 113 or any other clause wherein said coach room on each side of said hallway comprises a head coach room on one side and an assistant coach room on an other side of said hallway.
115. The sports hotel team social space as described in clause 114 or any other clause wherein said head coach room comprises a meeting space, bed, and bathroom for a head coach of a team.
116. The sports hotel team social space as described in clause 115 or any other clause wherein said meeting space in said head coach room comprises a conference table and an audio visual area.
117. The sports hotel team social space as described in clause 115 or any other clause wherein said meeting space is separated from said bed and bathroom in said head coach room.
118. The sports hotel team social space as described in clause 115 or any other clause wherein said bed comprises a king bed.
119. The sports hotel team social space as described in clause 93 or any other clause wherein said at least one wing comprises player rooms.
120. The sports hotel team social space as described in clause 113 or any other clause wherein said plurality of rooms located on each side of said hallway comprises up to about eight player rooms on each side of said hallway sequentially located next to each of said coach room.
121. The sports hotel team social space as described in clause 120 or any other clause wherein said plurality of rooms located on each side of said hallway comprises a second coach room on each side of said hallway located next to said up to about eight player rooms.
122. The sports hotel team social space as described in clause 119 or 120 or any other clause wherein said player room comprises two beds and a bathroom.
123. The sports hotel team social space as described in clause 119 or 120 or any other clause wherein said player room comprises one bed and a bathroom.
124. The sports hotel team social space as described in clause 122 or any other clause wherein said bed comprises a king bed.
125. The sports hotel team social space as described in clause 122 or any other clause wherein said bed comprises an oversized king bed.
126. The sports hotel team social space as described in clause 120 or any other clause wherein said up to about eight player rooms on each side of said hallway sequentially located next each of said coach room comprises seven player rooms on one side of a hallway and eight player rooms located on another side of said hallway.
127. The sports hotel team social space as described in clause 126 or any other clause wherein one of said coach rooms comprises an assistant coach room and wherein said seven player rooms on one side of a hallway are located next to said assistant coach room.
128. The sports hotel team social space as described in clause 126 or any other clause wherein one of said coach rooms comprises a head coach room and wherein said eight player rooms on one side of a hallway are located next to said head coach room.

129. The sports hotel team social space as described in clause 114 or any other clause wherein said head coach room is bigger than said assistant coach room.

130. The sports hotel team social space as described in clause 93 or any other clause wherein said at least one wing comprises an equipment room.

131. The sports hotel team social space as described in clause 121 or any other clause and further comprising an equipment room located on one side of said hallway after said second coach room.

132. The sports hotel team social space as described in clause 131 or any other clause wherein a team room is parallel to said equipment room and said second coach room.

133. The sports hotel team social space as described in clause 130 or any other clause wherein said equipment room comprises a room configured to hold team equipment and uniforms.

134. The sports hotel team social space as described in clause 130 or any other clause wherein said equipment room comprises lockers, washer, and a dryer.

135. The sports hotel team social space as described in clause 114 or any other clause wherein said assistant coach room comprises a king bed and a reclining area for an assistant coach.

136. The sports hotel team social space as described in clause 135 or any other clause wherein said assistant coach comprises a coach selected from a group consisting of a team coordinator, a coach, and a non-head coach.

137. The sports hotel team social space as described in clause 93 or any other clause wherein said at least one floor comprises multiple floors.

138. The sports hotel team social space as described in clause 93 or any other clause wherein said at least one floor is selected from a group consisting of five floors of said hotel; eight floors of said hotel; and ten floors of said hotel.

139. The sports hotel team social space as described in clause 93 or any other clause wherein said hotel comprises a room capacity of 90 rooms, 180 rooms, and 360 rooms.

140. A hotel building exterior comprising:

a large-scale rectangular projection on at least a front of a building; and a plurality of patterned rectangular motif structures within said large-scale rectangular projection creating a pattern on said large-scale rectangular projection.

141. The hotel building exterior as described in clause 140 or any other clause wherein said large-scale rectangular projection covers an amount of said front of said building selected from a group of at least about 50%, at least about 60%, at least about 70%, at least about 80%, at least about 90% of said front of said building.

142. The hotel building exterior as described in clause 140 or any other clause wherein said front of said building comprises at least a front of one wing.

143. The hotel building exterior as described in clause 140 or any other clause wherein said front of said building comprises at least a front of one wing of a multiple winged hotel.

144. The hotel building exterior as described in clause 140 or any other clause wherein said large-scale rectangular projection is configured to at least partially project out from said front of said building.

145. The hotel building exterior as described in clause 140 or any other clause wherein said plurality of patterned rectangular motif structures comprises colored patterned rectangular motif structures.

146. The hotel building exterior as described in clause 145 or any other clause wherein said colored patterned rectangular motif structures are configured to change colors.

147. The hotel building exterior as described in clause 145 or any other clause wherein said colored patterned rectangular motif structures make at least one vertical pattern.

148. The hotel building exterior as described in clause 145 or any other clause wherein said colored patterned rectangular motif structures make at least one horizonal pattern.

149. The hotel building exterior as described in clause 145 or any other clause wherein said colored patterned rectangular motif structures make at least one horizonal pattern and at least one vertical pattern.

150. The hotel building exterior as described in clause 149 or any other clause wherein said at least one horizontal pattern is repeated within said large-scale rectangular projection and wherein said at least one vertical pattern is repeated within said large-scale rectangular projection.

151. An apparatus as described in clause 1, 45, 93, or 140 or any other clause and further comprising an electronic-sports arena attached to said hotel.

152. The apparatus as described in clause 151 or any other clause wherein said electronic-sports arena is configured to accommodate gaming competitions.

153. The apparatus as described in clause 151 or any other clause wherein said electronic-sports arena is about 300 square feet.

154. The apparatus as described in clause 151 or any other clause wherein said electronic-sports arena comprises an element selected from a group consisting of an exhibit, concessions, an entrance hall, a lobby, a VIP area, a virtual reality gym, a lounge, stadium seating, virtual reality floor seating, service station, a stage, and any combination thereof.

155. The apparatus as described in clause 154 or any other clause wherein said stadium seating comprises up to about 405 general seats.

156. The apparatus as described in clause 154 or any other clause wherein said virtual reality seating comprises up to about 30 seats.

157. The apparatus as described in clause 151 or any other clause wherein said electronic-sports arena is located between two wings of a hotel.

158. The apparatus as described in clause 157 or any other clause wherein said two wings of a hotel are radially placed about 120 degrees apart from each other.

159. The apparatus as described in clause 1, 45, 93, or 140 or any other clause and further comprising a treatment center in said hotel.

160. The apparatus as described in clause 159 or any other clause wherein said treatment center is located on a second floor of said hotel.

161. The apparatus as described in clause 159 or any other clause wherein said treatment center comprises an element selected from a group consisting of a stretching space, a rolling space, a private massage facility, an aquatic therapy tank, trainers, athletic trainers, individual treatment, group treatment, compression therapy, physical therapy, orthopedic professionals, doctors on call, ice baths, hot tubs, massages, therapeutic massage, and any combination thereof.

162. The apparatus as described in clause 1, 45, 93, or 140 or any other clause and further comprising a large-scale rectangular projection on at least a front of a building; and a plurality of patterned rectangular motif structures within said large-scale rectangular projection creating a pattern on said large-scale rectangular projection.

163. The apparatus as described in clause 162 or any other clause wherein said large-scale rectangular projection covers an amount of said front of said building selected from a group of at least about 50%, at least about 60%, at least about 70%, at least about 80%, at least about 90% of said front of said building.

164. The apparatus as described in clause 162 or any other clause wherein said front of said building comprises at least a front of one wing of a multiple winged hotel.

165. The apparatus as described in clause 162 or any other clause wherein said large-scale rectangular projection is configured to at least partially project out from said front of said building.

166. The apparatus as described in clause 162 or any other clause wherein said plurality of patterned rectangular motif structures comprises colored patterned rectangular motif structures.

167. The apparatus as described in clause 166 or any other clause wherein said colored patterned rectangular motif structures are configured to change colors.

168. The apparatus as described in clause 166 or any other clause wherein said colored patterned rectangular motif structures make at least one vertical pattern.

169. The apparatus as described in clause 166 or any other clause wherein said colored patterned rectangular motif structures make at least one horizonal pattern.

170. The apparatus as described in clause 166 or any other clause wherein said colored patterned rectangular motif structures make at least one horizonal pattern and at least one vertical pattern.

171. The apparatus as described in clause 170 or any other clause wherein said at least one horizontal pattern is repeated within said large-scale rectangular projection and wherein said at least one vertical pattern is repeated within said large-scale rectangular projection.

172. A method of providing a hotel team suite comprising the steps of:

providing a secured hotel wing comprising a hallway and a plurality of rooms located on each side of said hallway;

entering said secured hotel wing through a single door entry;

wherein said plurality of rooms comprises, at least two coaches room, player rooms, and an equipment room;

locating a coach room on each side of said hallway next to said single door entry;

locating up to about eight player rooms on each side of said hallway sequentially next to each of said coach rooms;

locating a second coach room on each side of said hallway next to said up to about eight player rooms;

locating an equipment room on one side of said hallway after one of said second coach room; and locating a team room at an end of said secured hotel wing next to said equipment room on one side of said hallway and next to said second coach room on an other side of said hallway.

173. The method as described in clause 172 or any other clause wherein said step of locating said coach room on each side of said hallway next to said single door entry comprises locating a head coach room on one side and an assistant coach room on an other side of said hallway.

174. The method as described in clause 172 or any other clause wherein said second coach room comprises an assistant coach room.

175. The method as described in clause 173 or any other clause wherein said step of locating said head coach room on one side of said hallway comprises a step of providing a meeting space, bed, and bathroom for a head coach of a team.

176. The method as described in clause 175 or any other clause wherein said meeting space in said head coach room comprises a conference table and an audio visual area.

177. The method as described in clause 175 or any other clause and further comprising a step of separating said bed and bathroom from said meeting space in said head coach room.

178. The method as described in clause 175 or any other clause wherein said bed comprises a king bed.

179. The method as described in clause 173 or 174 or any other clause wherein said step of providing an assistant coach room coach room on an other side of said hallway comprises a step of providing a king bed and a reclining area for an assistant coach.

180. The method as described in clause 179 or any other clause wherein said assistant coach comprises a coach selected from a group consisting of a team coordinator, a coach, and a non-head coach.

181. The method as described in clause 172 or any other clause wherein said player room comprises two beds and a bathroom.

182. The method as described in clause 172 or any other clause wherein said player room comprises one bed and a bathroom.

183. The method as described in clause 181 or 182 or any other clause wherein said bed comprises a king bed.

184. The method as described in clause 181 or 182 or any other clause wherein said bed comprises an oversized king bed.

185. The method as described in clause 172 or any other clause wherein said step of locating an equipment room at an end of said secured hotel wing comprises a step of configuring a room to accommodate team equipment and uniforms.

186. The method as described in clause 172 or any other clause wherein said equipment room comprises lockers, washer, and a dryer.

187. The method as described in clause 172 or any other clause wherein said team room comprises a meeting space, an audio visual area, and a physical recovery area.

188. The method as described in clause 187 or any other clause and further comprising separating said meeting space and said audio visual area from said physical recovery area.

189. The method as described in clause 187 or any other clause wherein said physical recovery area comprises at least one tub and at least one massage table.

190. The method as described in clause 187 or any other clause and further comprising a step of opening said physical recovery to said meeting space and said audio visual area.

191. The method as described in clause 189 or any other clause wherein said physical recovery area comprises two tubs and three massage tables.
192. The method as described in clause 189 or any other clause wherein said at least one tub comprises a therapy tub.
193. The method as described in clause 172 or any other clause and further comprising a step of locating said team room parallel to said equipment room and said second coach room.
194. The method as described in clause 172 or any other clause and further comprising a step of providing a larger team room than said equipment room and said second coach room.
195. The method as described in clause 172 or any other clause and further comprising a step of locating said team room adjacent to said equipment room and said second coach room.
196. The method as described in clause 172 or any other clause and further comprising a step of locating said single door entry near an elevator.
197. The method as described in clause 172 or any other clause and further comprising a step of locating said single door entry at one end of said secured hotel wing.
198. The method as described in clause 172 or any other clause and further comprising a step of locating each of said coach room across from each other.
199. The method as described in clause 172 or any other clause wherein said step of locating up to about eight player rooms on each side of said hallway comprises a step of locating seven player rooms on one side of said hallway and locating eight player rooms on another side of said hallway.
200. The method as described in clause 199 or any other clause wherein one of said coach rooms comprises an assistant coach room and further comprising a step of locating said seven player rooms on one side of a hallway next to said assistant coach room.
201. The method as described in clause 199 or any other clause wherein one of said coach rooms comprises a head coach room and further comprising a step of locating said eight player rooms on one side of a hallway next to said head coach room.
202. The method as described in clause 173 or any other clause comprising a step of providing a bigger head coach room than said assistant coach room.
203. The method as described in clause 172 or any other clause wherein said step of providing a secured hotel wing comprises a step of providing two secured hotel wings on a floor of a hotel.
204. The method as described in clause 172 or any other clause wherein said step of providing a secured hotel wing comprises a step of providing three secured hotel wings on a floor of a hotel.
205. The method as described in clause 172 or any other clause wherein said step of providing said secured hotel wing comprises a step of locating said secured hotel wing on at least one floor of a hotel.
206. The method as described in clause 172 or any other clause wherein said secured hotel wing comprises a substantially rectangular shape.
207. The method as described in clause 203 or any other clause and further comprising a step of radially placing said two secured hotel wings about 120 degrees apart from each other.
208. The method as described in clause 204 or any other clause and further comprising a step of radially placing said three secured hotel wings about 120 degrees apart from each other.
209. The method as described in clause 203 or 204 or any other clause and further comprising a step of centering said secured hotel wings around a social team area.
210. The method as described in clause 209 or any other clause and further comprising a step of locating said social team area near a center of a hotel building.
211. The method as described in clause 210 or any other clause and further comprising a step of locating said social team area near at least one elevator of a hotel building.
212. The method as described in clause 205 or any other clause wherein said at least one floor comprises multiple floors.
213. The method as described in clause 205 or any other clause wherein said at least one floor is selected from a group consisting of five floors of said hotel; eight floors of said hotel; and ten floors of said hotel.
214. The method as described in clause 205 or any other clause wherein said hotel comprises a room capacity of 90 rooms, 180 rooms, and 360 rooms.
215. A method of providing a hotel comprising the steps of providing a team room in a hotel wing on a floor of said hotel, wherein said team room comprises a meeting space, an audio visual area, and a physical recovery area.
216. The method as described in clause 215 or any other clause and further comprising a step of securing said team room.
217. The method as described in clause 216 or any other clause wherein said step of securing said team room comprises a step of allowing only guests staying in said wing access to said team room.
218. The method as described in clause 215 or any other clause and further comprising a step of separating said meeting space and said audio visual area from said physical recovery area.
219. The method as described in clause 215 or any other clause wherein said physical recovery area comprises at least one tub and at least one massage table.
220. The method as described in clause 215 or any other clause and further comprising a step of opening said physical recovery area to said meeting space and said audio visual area.
221. The method as described in clause 219 or any other clause wherein said physical recovery area comprises two tubs and three massage tables.
222. The method as described in clause 219 or any other clause wherein said at least one tub comprises a therapy tub.
223. The method as described in clause 215 or any other clause and further comprising a step of locating said team room at an end of said hotel wing.
224. The method as described in clause 215 or any other clause and further comprising a step of securing said hotel wing.
225. The method as described in clause 224 or any other clause wherein said step of securing said hotel wing comprises a step of providing a single door entry to enter said secured hotel wing.
226. The method as described in clause 215 or any other clause and further comprising a step of providing a hallway and a plurality of rooms located on each side of said hallway in said hotel wing.

227. The method as described in clause 215 or any other clause wherein said hotel wing comprises two hotel wings on a floor of a hotel.
228. The method as described in clause 215 or any other clause wherein said hotel wing comprises three hotel wings on a floor of a hotel.
229. The method as described in clause 215 or any other clause and further comprising a step of locating said hotel wing on at least one floor of a hotel.
230. The method as described in clause 215 or any other clause wherein said hotel wing comprises a substantially rectangular shape.
231. The method as described in clause 227 or any other clause wherein said two hotel wings are radially placed about 120 degrees apart from each other.
232. The method as described in clause 228 or any other clause wherein said three hotel wings are radially placed about 120 degrees apart from each other.
233. The method as described in clause or any other clause 227 or 228 wherein said hotel wings are centered around a social team area.
234. The method as described in clause 233 or any other clause and further comprising a step of locating said social team area near a center of a hotel building.
235. The method as described in clause 233 or any other clause and further comprising a step of locating said social team area near at least one elevator of said hotel.
236. The method as described in clause 226 or any other clause wherein said step of providing said plurality of rooms located on each side of said hallway comprises a step of locating a coach room on each side of said hallway next to a single door entry.
237. The method as described in clause 236 or any other clause wherein said step of locating said coach room on each side of said hallway comprises a step of locating a head coach room on one side of said hallway and an assistant coach room on an other side of said hallway.
238. The method as described in clause 237 or any other clause wherein said head coach room comprises a meeting space, bed, and bathroom for a head coach of a team.
239. The method as described in clause 238 or any other clause wherein said meeting space in said head coach room comprises a conference table and an audio visual area.
240. The method as described in clause 238 or any other clause and further comprising a step of separating said meeting space from said bed and bathroom in said head coach room.
241. The method as described in clause 238 or any other clause wherein said bed comprises a king bed.
242. The method as described in clause 215 or any other clause and further comprising a step of providing player rooms in said hotel wing.
243. The method as described in clause 236 or any other clause wherein said step of providing said plurality of rooms located on each side of said hallway comprises a step of locating up to about eight player rooms on each side of said hallway sequentially next to each of said coach room.
244. The method as described in clause 243 or any other clause and further comprising a step of locating a second coach room on each side of said hallway next to said up to about eight player rooms.
245. The method as described in clause 242 or 243 or any other clause wherein said player room comprises two beds and a bathroom.
246. The method as described in clause 242 or 243 or any other clause wherein said player room comprises one bed and a bathroom.
247. The method as described in clause 245 or any other clause wherein said bed comprises a king bed.
248. The method as described in clause 245 or any other clause wherein said bed comprises an oversized king bed.
249. The method as described in clause 243 or any other clause wherein step of locating said up to about eight player rooms on each side of said hallway comprises a step of locating seven player rooms on one side of a hallway and eight player rooms on an other side of said hallway.
250. The method as described in clause 249 or any other clause wherein one of said coach rooms comprises an assistant coach room and further comprising a step of locating said seven player rooms on one side of a hallway next to said assistant coach room.
251. The method as described in clause 249 or any other clause wherein one of said coach rooms comprises a head coach room and further comprising a step of locating said eight player rooms on an other side of a hallway next to said head coach room.
252. The method as described in clause 237 or any other clause and further comprising a step of providing a bigger head coach room than said assistant coach room.
253. The method as described in clause 215 or any other clause and further comprising a step of providing an equipment room in said hotel wing.
254. The method as described in clause 244 or any other clause and further comprising a step of locating an equipment room on one side of said hallway after said second coach room.
255. The method as described in clause 254 or any other clause and further comprising a step of locating said team room parallel to said equipment room and said second coach room.
256. The method as described in clause 253 or any other clause and further comprising a step of configuring said equipment room to accommodate team equipment and uniforms.
257. The method as described in clause 253 or any other clause wherein said equipment room comprises lockers, washer, and a dryer.
258. The method as described in clause 237 or any other clause wherein said assistant coach room comprises a king bed and a reclining area for an assistant coach.
259. The method as described in clause 258 or any other clause wherein said assistant coach comprises a coach selected from a group consisting of a team coordinator, a coach, and a non-head coach.
260. The method as described in clause 229 or any other clause wherein said at least one floor comprises multiple floors.
261. The method as described in clause 229 or any other clause wherein said at least one floor is selected from a group consisting of five floors of said hotel; eight floors of said hotel; and ten floors of said hotel.
262. The method as described in clause 215 or any other clause wherein said hotel comprises a room capacity of 90 rooms, 180 rooms, and 360 rooms.
263. A method for providing a sports hotel team social space comprising:
providing at least one floor of a hotel having at least one wing; and locating a communal zone near said at least one wing and near an elevator of said hotel.

264. The method as described in clause 263 or any other clause and further comprising a step of locating said communal zone near a center of said hotel.

265. The method as described in clause 263 or any other clause and further comprising a step of securing said at least one wing.

266. The method as described in clause 263 or any other clause wherein said at least one wing comprises two wings on a floor of said hotel.

267. The method as described in clause 263 or any other clause wherein said at least one wing comprises three wings on a floor of said hotel.

268. The method as described in clause 263 or any other clause wherein said at least one wing comprises a substantially rectangular shape.

269. The method as described in clause 266 or any other clause and further comprising a step of radially placing said two wings on said floor of said hotel about 120 degrees apart from each other.

270. The method as described in clause 267 or any other clause and further comprising a step of radially placing said three wings on said floor of said hotel about 120 degrees apart from each other.

271. The method as described in clause 266 or any other clause and further comprising a step of centering said wings around said communal zone.

272. The method as described in clause 263 or any other clause and further comprising a step of locating said communal zone near a center of said hotel.

273. The method as described in clause 263 or any other clause wherein said communal zone comprises at least one seating area, at least one television, and at least one game area.

274. The method as described in clause 265 or any other clause wherein said step of securing said at least one wing comprises a step of providing a single door entry to said wing.

275. The method as described in clause 263 or any other clause and further comprising a step of providing a hallway and locating a plurality of rooms on each side of said hallway in said wing.

276. The method as described in clause 275 or any other clause wherein said plurality of rooms comprises a team room.

277. The method as described in clause 276 or any other clause wherein said team room comprises a meeting space, an audio visual area, and a physical recovery area.

278. The method as described in clause 277 or any other clause and further comprising a step of separating said meeting space and said audio visual area from said physical recovery area.

279. The method as described in clause 277 or any other clause wherein said physical recovery area comprises at least one tub and at least one massage table.

280. The method as described in clause 277 or any other clause and further comprising a step of opening said physical recovery area to said meeting space and said audio visual area.

281. The method as described in clause 277 or any other clause wherein said physical recovery area comprises two tubs and three massage tables.

282. The method as described in clause 279 or any other clause wherein said at least one tub comprises a therapy tub.

283. The method as described in clause 276 or any other clause and further comprising a step of locating said team room at an end of said hotel wing.

284. The method as described in clause 275 or any other clause wherein said step of locating said plurality of rooms on each side of said hallway comprises a step of locating a coach room on each side of said hallway next to a single door entry.

285. The method as described in clause 284 or any other clause wherein said step of locating a coach room on each side of said hallway comprises a step of locating a head coach room on one side of said hallway and locating an assistant coach room on an other side of said hallway.

286. The method as described in clause 285 or any other clause wherein said head coach room comprises a meeting space, bed, and bathroom for a head coach of a team.

287. The method as described in clause 286 or any other clause wherein said meeting space in said head coach room comprises a conference table and an audio visual area.

288. The method as described in clause 286 or any other clause and further comprising a step of separating said meeting space from said bed and bathroom in said head coach room.

289. The method as described in clause 286 or any other clause wherein said bed comprises a king bed.

290. The method as described in clause 263 or any other clause and further comprising a step of providing player rooms in said at least one wing.

291. The method as described in clause 284 or any other clause wherein said step of providing said plurality of rooms located on each side of said hallway comprises a step of locating up to about eight player rooms on each side of said hallway sequentially next to each of said coach room.

292. The method as described in clause 291 or any other clause and further comprising a step of locating a second coach room on each side of said hallway next to said up to about eight player rooms.

293. The method as described in clause 290 or 291 or any other clause wherein said player room comprises two beds and a bathroom.

294. The method as described in clause 290 or 291 or any other clause wherein said player room comprises one bed and a bathroom.

295. The method as described in clause 293 or any other clause wherein said bed comprises a king bed.

296. The method as described in clause 293 or any other clause wherein said bed comprises an oversized king bed.

297. The method as described in clause 291 or any other clause wherein step of locating said up to about eight player rooms on each side of said hallway comprises a step of locating seven player rooms on one side of a hallway and eight player rooms on an other side of said hallway.

298. The method as described in clause 297 or any other clause wherein one of said coach rooms comprises an assistant coach room and further comprising a step of locating said seven player rooms on one side of a hallway next to said assistant coach room.

299. The method as described in clause 297 or any other clause wherein one of said coach rooms comprises a head coach room and further comprising a step of locating said eight player rooms on an other side of a hallway next to said head coach room.

300. The method as described in clause 285 or any other clause and further comprising a step of providing a bigger head coach room than said assistant coach room.

301. The method as described in clause 263 or any other clause and further comprising a step of providing an equipment room in said hotel wing.

302. The method as described in clause 283 or any other clause and further comprising a step of locating an equipment room on one side of said hallway after said second coach room.

303. The method as described in clause 302 or any other clause and further comprising a step of locating said team room parallel to said equipment room and said second coach room.

304. The method as described in clause 301 or any other clause and further comprising a step of configuring said equipment room to accommodate team equipment and uniforms.

305. The method as described in clause 301 or any other clause wherein said equipment room comprises lockers, washer, and a dryer.

306. The method as described in clause 285 or any other clause wherein said assistant coach room comprises a king bed and a reclining area for an assistant coach.

307. The method as described in clause 306 or any other clause wherein said assistant coach comprises a coach selected from a group consisting of a team coordinator, a coach, and a non-head coach.

308. The method as described in clause 263 or any other clause wherein said at least one floor comprises multiple floors.

309. The method as described in clause 263 or any other clause wherein said at least one floor is selected from a group consisting of five floors of said hotel; eight floors of said hotel; and ten floors of said hotel.

310. The method as described in clause 263 or any other clause wherein said hotel comprises a room capacity of 90 rooms, 180 rooms, and 360 rooms.

311. A method for providing a hotel building exterior comprising:

providing a large-scale rectangular projection on at least a front of a building;

placing a plurality of patterned rectangular motif structures within said large-scale rectangular projection; and creating a pattern on said large-scale rectangular projection.

312. The method as described in clause 311 or any other clause wherein said large-scale rectangular projection covers an amount of said front of said building selected from a group of at least about 50%, at least about 60%, at least about 70%, at least about 80%, at least about 90% of said front of said building.

313. The method as described in clause 311 or any other clause wherein said front of said building comprises at least a front of one wing of a multiple winged hotel.

314. The method as described in clause 311 or any other clause wherein said step of providing said large-scale rectangular projection on said at least a front of a building comprises a step of providing that at least part of said large-scale rectangular projection partially projects out from said front of said building.

315. The method as described in clause 311 or any other clause wherein said plurality of patterned rectangular motif structures comprises a plurality of colored patterned rectangular motif structures.

316. The method as described in clause 315 or any other clause and further comprising a step of changing colors of said colored patterned rectangular motif structures.

317. The method as described in clause 315 or any other clause and further comprising a step of making at least one vertical pattern with said colored patterned rectangular motif structures.

318. The method as described in clause 315 or any other clause and further comprising a step of making at least one horizontal pattern with said colored patterned rectangular motif structures.

319. The method as described in clause 315 or any other clause and further comprising a step of making at least one horizontal pattern and at least one vertical pattern with said colored patterned rectangular motif structures.

320. The method as described in clause 319 or any other clause and further comprising a step of repeating said at least one horizontal pattern and said at least one vertical pattern within said large-scale rectangular projection.

321. The method as described in clause 172, 215, 263, or 311 or any other clause and further comprising a step of attaching an electronic-sports arena to said hotel.

322. The method as described in clause 321 or any other clause and further comprising a step of providing gaming competitions in said electronic-sports arena.

323. The method as described in clause 321 or any other clause wherein said electronic-sports arena is about 300 square feet.

324. The method as described in clause 321 or any other clause and further comprising a step of providing an element selected from a group consisting of an exhibit, concessions, an entrance hall, a lobby, a VIP area, a virtual reality gym, a lounge, stadium seating, virtual reality floor seating, service station, a stage, and any combination thereof wherein said electronic-sports arena.

325. The method as described in clause 324 or any other clause and further comprising a step of providing about up to about 405 general seats in said stadium seating.

326. The method as described in clause 324 or any other clause and further comprising a step of providing up to about 30 seats in said virtual reality seating.

327. The method as described in clause 321 or any other clause and further comprising a step of locating said electronic-sports arena is between two wings of a hotel.

328. The method as described in clause 327 or any other clause and further comprising a step of radially placing said two wings of a hotel about 120 degrees apart from each other.

329. The method as described in clause 172, 215, 263, or 311 or any other clause and further comprising a step of providing a treatment center in said hotel.

330. The method as described in clause 329 or any other clause and further comprising a step of locating said treatment center on a second floor of said hotel.

331. The method as described in clause 329 or any other clause wherein said treatment center comprises an element selected from a group consisting of a stretching space, a rolling space, a private massage facility, an aquatic therapy tank, trainers, athletic trainers, individual treatment, group treatment, compression therapy, physical therapy, orthopedic professionals, doctors on call, ice baths, hot tubs, massages, therapeutic massage, and any combination thereof.

332. The method as described in clause 172, 215, 263, or 311 or any other clause and further comprising a step of providing a large-scale rectangular projection on at least a front of a building; placing a plurality of patterned rectangular motif structures within said large-scale rectangular projection; and creating a pattern on said large-scale rectangular projection.

333. The method as described in clause 332 or any other clause wherein said large-scale rectangular projection covers an amount of said front of said building selected from a group of at least about 50%, at least about 60%, at least about 70%, at least about 80%, at least about 90% of said front of said building.

334. The method as described in clause 332 or any other clause wherein said front of said building comprises at least a front of one wing of a multiple winged hotel.

335. The method as described in clause 332 or any other clause wherein said step of providing said large-scale rectangular projection on said at least a front of a building comprises a step of providing that at least part of said large-scale rectangular projection partially projects out from said front of said building.

336. The method as described in clause 332 or any other clause wherein said plurality of patterned rectangular motif structures comprises a plurality of colored patterned rectangular motif structures.

337. The method as described in clause 336 or any other clause and further comprising a step of changing colors of said colored patterned rectangular motif structures.

338. The method as described in clause 336 or any other clause and further comprising a step of making at least one vertical pattern with said colored patterned rectangular motif structures.

339. The method as described in clause 336 or any other clause and further comprising a step of making at least one horizontal pattern with said colored patterned rectangular motif structures.

340. The method as described in clause 336 or any other clause and further comprising a step of making at least one horizontal pattern and at least one vertical pattern with said colored patterned rectangular motif structures.

341. The method as described in clause 340 or any other clause and further comprising a step of repeating said at least one horizontal pattern and said at least one vertical pattern within said large-scale rectangular projection.

As can be easily understood from the foregoing, the basic concepts of the present invention may be embodied in a variety of ways. It involves both hotel design techniques as well as devices to accomplish the appropriate hotel design. In this application, the hotel design techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "projection" should be understood to encompass disclosure of the act of "projecting"—whether explicitly discussed or not—and, conversely, were there effectively disclosure of the act of "projecting", such a disclosure should be understood to encompass disclosure of a "projection" and even a "means for projecting." Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

REFERENCES TO BE INCORPORATED BY REFERENCE

I. U.S. patents

| Pat. No. | Kind Code | Date Issued | Patentee |
|---|---|---|---|
| 3,302,340 | A | 1967 Feb. 7 | Chertkof |
| 3,346,997 | A | 1967 Oct. 17 | Parrish |
| 4,650,179 | | 1987 Mar. 17 | Bond |
| 5,806,260 | | 1998 Sep. 15 | Quaintance |
| 6,141,924 | | 2000 Nov. 7 | Quaintance |
| 6,155,012 | | 2000 Dec. 5 | Halbitte |
| D736947 | S | 2015 Aug. 18 | Webb |
| D216424 | S | 1970 Jan. 6 | Estes et al. |
| D241648 | S | 1976 Sep. 28 | Magill |
| D212844 | S | 1968 Dec. 3 | Mullen |
| D197555 | S | 1964 Feb. 25 | Garrett |
| 1,096,758 | A | 1914 May 12 | Rogers |
| D252216 | S | 1979 Jun. 26 | Whitney |
| D246802 | S | 1977 Dec. 27 | Mondragon |
| 4,462,191 | A | 1984 Jul. 31 | Poirier |
| 2,154,897 | A | 1939 Apr. 18 | GRANT |
| 3,033,499 | A | 1962 May 8 | ASH |
| D712067 | S1 | 2014 Aug. 26 | Backus et al. |
| D750274 | S1 | 2016 Feb. 23 | O'Callaghan et al. |
| D750275 | S1 | 2016 Feb. 23 | O'Callaghan et al. |
| 8,544,217 | B2 | 2013 Oct. 1 | Andreini et al. |
| 9,016,000 | B2 | 2015 Apr. 28 | Elliott et al. |
| 9,771,731 | B2 | 2017 Sep. 26 | Canavati |

II. US PUBLICATIONS

| Publication No. | Kind Code | Date Published | Patentee |
|---|---|---|---|
| 20070074471 | A1 | 2007 Apr. 5 | Gallagher |
| 20170175409 | A1 | 2017 Jun. 22 | Canavati |
| 20180194442 | A1 | 2018 Jul. 12 | LOUDRUP |
| 20140096456 | A1 | 2014 Apr. 10 | Andreini et al. |
| 20150089890 | A1 | 2015 Apr. 02 | McLoughlin et al. |

III. NON-PATENT LITERATURE

Provisional Application No. 62/660,055, First Named Inventor Richard Shawn Ellis, Filed Apr. 19, 2018
Design Application No. 29/644,699, First Named Inventor Richard Shawn Ellis, Filed Apr. 19, 2018
Office Action from Design Application No. 29/644,699, First Named Inventor Richard Shawn Ellis, dated Feb. 28, 2019, 8 pages
ELIZABETH OLSON, For Athletes, a Home for Away Games, The New York Times, Nov. 4, 2013, 4 pages
RISING STAR SPORTS RANCH RESORT, a Resort Like No Other, Apr. 17, 2018, 4 pages Thus, the applicant(s) should be understood to have support to claim and make a statement of invention to at least: i) each of the hotel system devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A hotel comprising:

at least three secured hotel wings each comprising a hallway and a plurality of rooms located on each side of said hallway;

wherein each of said secured hotel wings has a rectangular exterior shape comprising a first straight side, a second straight side, a first end, and a second end;

wherein said first and second straight sides are longer than said first and second ends;

wherein said first straight side is parallel to said second straight side;

wherein said first end of said secured hotel wing is near a central hub; and wherein said second end of said secured hotel wing is on an opposite end of said first end;

a single door entry into each of said secured hotel wings located near said first end of said secured hotel wing;

wherein said plurality of rooms in each of said secured hotel wings comprises:

a plurality of rooms on a first side of said hallway arranged in a first row and bordering said first straight side of said secured hotel wing;

a plurality of rooms on a second side of said hallway arranged in a second row and bordering said second straight side of said secured hotel wing;

wherein a first end room at an end of said first row of said plurality of rooms borders an inside of said second end of said secured hotel wing; and wherein a second end room of said second row of said plurality of rooms borders said inside of said second end of said secured hotel wing;

a team room located at said second end of each of said secured hotel wings;

wherein said team room comprises four sides, one of said sides is adjacent to said first end room and said second end room and borders an outside of said second end of said secure hotel wing;

wherein three of said four sides of said team room are exterior sides;

wherein said at least three secured hotel wings are organized around said central hub;

wherein said central hub comprises a social space accessible through said single door entry of each of said secured hotel wings; and further comprising a rectangular projection on a front exterior of said first or said second straight side of at least one of said secured hotel wings, wherein said rectangular projection is connected to said straight side of at least one of said secured hotel wings, wherein part of said rectangular projection is configured to project out from said front exterior of said first or said second straight side of said at least one of said secured hotel wings, and wherein a second part of said rectangular projection is configured to project inward from said front exterior of said first or said second straight sides of said at least one of said secured hotel wings.

2. The hotel as described in claim 1 wherein said plurality of rooms comprises at least one of coach room.

3. The hotel as described in claim 2 wherein said coach room comprises a meeting space, bed, and bathroom for a head coach of a team.

4. The hotel as described in claim 3 wherein said meeting space in said coach room comprises a conference table and an audio visual area.

5. The hotel as described in claim 1 wherein said team room comprises a meeting space, an audio visual area, and a physical recovery area.

6. The hotel as described in claim 5 wherein said meeting space and said audio visual area are separatable from said physical recovery area.

7. The hotel as described in claim 5 wherein said physical recovery area comprises at least one tub and at least one massage table.

8. The hotel as described in claim 5 wherein said physical recovery area is open to said meeting space and said audio visual area.

9. The hotel as described in claim 1 wherein said single door entry is located near an elevator.

10. The hotel as described in claim 1 wherein said plurality of rooms comprises up to about eight player rooms on each side of said hallway in each of said secured hotel wings.

11. The hotel as described in claim 1 wherein said social space is located near at least one elevator of a hotel building.

12. The hotel as described in claim 1 wherein each of said three secured hotel wings comprises multiple floors.

13. The hotel as described in claim 12 wherein said multiple floors is chosen from five floors of said hotel; eight floors of said hotel; and ten floors of said hotel.

14. The hotel as described in claim 12 wherein each floor of said multiple floors comprises said secured hotel wing and said social space.

15. The hotel as described in claim 1 wherein said secured hotel wing is located in a hotel comprising a room capacity chosen from 90 rooms, 180 rooms, and 360 rooms.

16. The hotel as described in claim 1 and further comprising an electronic-sports arena near said one of said secured hotel wings.

17. The hotel as described in claim 16 wherein said electronic-sports arena comprises an element chosen from an exhibit, concessions, an entrance hall, a lobby, a VIP area, a virtual reality gym, a lounge, stadium seating, virtual reality floor seating, service station, a stage, and any combination thereof.

18. The hotel as described in claim 16 wherein said electronic-sports arena is located between two of said three secured hotel wings of a hotel.

* * * * *